US008219000B2

(12) United States Patent
Kuma et al.

(10) Patent No.: US 8,219,000 B2
(45) Date of Patent: Jul. 10, 2012

(54) IMAGE FORMING APPARATUS CAPABLE OF EFFECTIVELY PERFORMING A MAINTENANCE OPERATION

(75) Inventors: Kazuosa Kuma, Kanagawa-ken (JP); Nobuto Yokokawa, Kanagawa-ken (JP); Mitsuru Takahashi, Kanagawa-ken (JP); Kazuchika Saeki, Kanagawa-ken (JP); Takeshi Fukao, Kanagawa-ken (JP); Tsutomu Katoh, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 698 days.

(21) Appl. No.: 11/608,175

(22) Filed: Dec. 7, 2006

(65) Prior Publication Data

US 2007/0127947 A1 Jun. 7, 2007

(30) Foreign Application Priority Data

Dec. 7, 2005 (JP) ..... 2005-353955

(51) Int. Cl.
*G03G 15/16* (2006.01)

(52) U.S. Cl. ..... 399/121

(58) Field of Classification Search ..... 399/121
See application file for complete search history.

(56) References Cited

U.S. PATENT DOCUMENTS 4,116,556 A * 9/1978 Tanaka et al. ..... 399/121
5,038,173 A * 8/1991 Kusumoto ..... 399/13
5,854,955 A * 12/1998 Yawata et al. ..... 399/111
5,923,935 A * 7/1999 Yamaguchi ..... 399/297
6,131,008 A * 10/2000 Kanamori et al. ..... 399/263
6,144,822 A 11/2000 Yamaguchi et al.
6,249,661 B1 * 6/2001 Saitoh et al. ..... 399/117
6,490,426 B1 * 12/2002 Zaman ..... 399/117
6,530,692 B2 * 3/2003 Wyer ..... 384/295
7,164,876 B2 * 1/2007 Yoo et al. ..... 399/116
2005/0063713 A1 3/2005 Watanabe et al.
2005/0084288 A1 * 4/2005 Yoo et al. ..... 399/116
2005/0169667 A1 8/2005 Katoh
2005/0231821 A1 10/2005 Tsuda et al.
2005/0254861 A1 * 11/2005 Schlageter et al. ..... 399/258
2006/0045570 A1 3/2006 Kato et al.
2006/0045603 A1 3/2006 Hatori et al.

(Continued)

FOREIGN PATENT DOCUMENTS

CN 1122199 C 9/2003

(Continued)

OTHER PUBLICATIONS

Machine translation of JP 11-093940 A.*

(Continued)

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

A roller device that can be exchangeably used in an image forming apparatus includes a roller, a shaft, and two grip members. The roller is configured to cover the shaft along the rotation axis and have two roller ends from which the two shaft end portions of the shaft are projected outwardly along the rotation axis. A shaft is configured to have a rotation axis at a center thereof and have two shaft end portions. The two grip members are each configured to be rotatably disposed to a respective shaft end portion of the two shaft end portions.

41 Claims, 17 Drawing Sheets

U.S. PATENT DOCUMENTS

| | | | | |
|---|---|---|---|---|
| 2006/0177231 | A1* | 8/2006 | Mori et al. | 399/12 |
| 2006/0210307 | A1 | 9/2006 | Katoh et al. | |
| 2006/0210324 | A1 | 9/2006 | Kuma et al. | |

FOREIGN PATENT DOCUMENTS

| | | | |
|---|---|---|---|
| JP | 02253287 | A * | 10/1990 |
| JP | 05-213472 | | 8/1993 |
| JP | 08-123119 | | 5/1996 |
| JP | 08-202170 | | 8/1996 |
| JP | 11176631 | A * | 7/1999 |
| JP | 2002-258635 | | 9/2002 |
| JP | 2004-252089 | | 9/2004 |
| JP | 2004-279923 | | 10/2004 |
| JP | 2004-325485 | | 11/2004 |

OTHER PUBLICATIONS

U.S. Appl. No. 11/934,981, filed Nov. 5, 2007, Furuya, et al.
U.S. Appl. No. 11/943,941, filed Nov. 21, 2007, Katoh, et al.
Office Action issued Jul. 29, 2011 in Japanese Patent Application No. 2011-049789.

* cited by examiner

IMAGE FORMING APPARATUS CAPABLE OF EFFECTIVELY PERFORMING A MAINTENANCE OPERATION

CROSS REFERENCE TO RELATED APPLICATIONS

This patent specification is based on Japanese Patent Application No. JP2005-353955, filed on Dec. 7, 2005 in the Japan Patent Office, the entire contents of which are incorporated by reference herein.

BACKGROUND OF THE INVENTION

1. Field of the Invention

The present invention relates to an image forming apparatus, and more particularly to an image forming apparatus capable of effectively performing a maintenance operation by increasing operability of a roller device.

2. Description of the Related Art

Conventionally, an image forming apparatus, such as a copier, a printer, a facsimile, or a multi-function device, which uses an electrophotographic method, generally employs a transfer roller as a mechanism to transfer a toner image formed on a surface of an image carrier onto a recording member. The transfer roller includes a metal core and a conductive elastic body layer. The conductive elastic body layer is made of conductive rubber, conductive sponge, etc., and is integrally formed in a roller shape around the metal core.

The transfer roller is rotatably supported on both ends thereof by shaft receiving members, and contacts, with pressure, the surface of the image carrier. When the recording member is passed through a nip portion between the transfer roller and the surface of the image carrier, the transfer roller is applied with a polarity opposite to a charged polarity of the toner image. Thus, the toner image is transferred onto a surface of the recording member.

In this regard, since the conductive elastic body layer of the transfer roller contacts, with pressure, the surface of the image carrier, the conductive elastic body layer of the transfer roller is worn out in continuous use. A surface of the conductive elastic body layer of the transfer roller is abraded due to a difference in linear velocity between the transfer roller and the image carrier. In addition, attachment of toner or paper dust may cause a change in a surface property of the conductive elastic body layer, thereby deteriorating transfer performance thereof and image quality.

For these reasons, the transfer roller is generally configured to be attachable to and detachable from an image forming apparatus so as to be quickly replaced with a replacement transfer roller when the transfer roller is degraded.

So far, a replacement operation of such a roller member in the image forming apparatus has been generally performed by technical support staff familiar with replacing transfer rollers. That is, general users have hardly performed the replacement operation. As a result, not much attention has been paid to operability of a replacement roller member in the replacement operation thereof.

However, general users are increasingly performing the replacement operation by themselves for some reasons, such as saving on maintenance costs of an image forming apparatus. Therefore, an increase in operability of the replacement roller member is desired so that general users may properly and effectively perform the replacement operation thereof.

SUMMARY OF THE INVENTION

This patent specification describes a roller device for use in an image forming apparatus in which a maintenance operation can be effectively performed by increasing operability of a replacement roller device. In one example, a roller device includes a roller, a shaft, and two grip members. The roller is configured to cover the shaft along the rotation axis and have two roller ends from which the two shaft end portions of the shaft are projected outwardly along the rotation axis. A shaft is configured to have a rotation axis at a center thereof and have two shaft end portions. The two grip members are configured to be rotatably disposed to a respective shaft end portion of the two shaft end portions.

This patent specification further describes a roller replacement package for use in an image forming apparatus in which a maintenance operation can be effectively performed by increasing operability of a replacement roller device. In one example, a roller replacement package includes a roller device, a housing member, and a supporter. The roller device includes a roller, a shaft, and two grip members. The roller is configured to cover the shaft along the rotation axis and have two roller ends from which the two shaft end portions of the shaft are projected outwardly along the rotation axis. The shaft is configured to have a rotation axis at a center thereof and have two shaft end portions. The two grip members are configured to be rotatably disposed to a respective shaft end portion of the two shaft end portions. The housing member is configured to house the roller device, wherein the housing member has an outlet through which the roller device is installed and removed, and the outlet is formed such that the roller device is installed and removed in a direction perpendicular to the rotation axis. The supporter is configured to support the roller device such that the two grip members of the roller device are positioned towards the outlet of the housing member.

This patent specification still further describes an image forming apparatus in which a maintenance operation can be effectively performed by increasing operability of a replacement roller device. In one example, an image forming apparatus includes a roller device, a bearing member, and a supporter. The roller device is configured to be exchangeably used in the image forming apparatus. The bearing member is configured to be attached to one of the two shaft end portions. The supporter is configured to support the shaft by holding the one of the two shaft end portions through the bearing. The roller device includes a roller, a shaft, and two grip members. The roller is configured to cover the shaft along the rotation axis and have two roller ends from which the two shaft end portions of the shaft are projected outwardly along the rotation axis. The shaft is configured to have a rotation axis at a center thereof and have two shaft end portions. The two grip members are configured to be rotatably disposed to a respective shaft end portion of the two shaft end portions.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
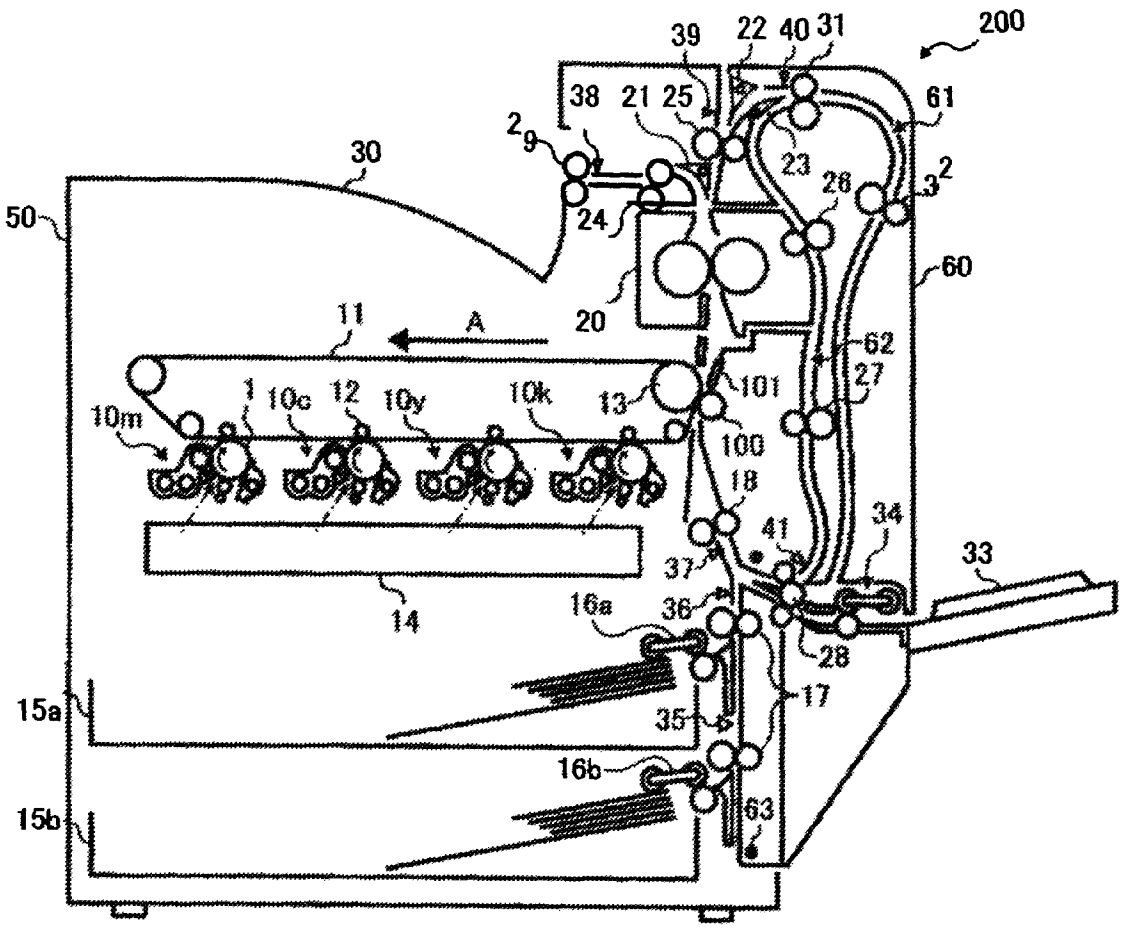
FIG. 1 is a schematic configuration diagram illustrating an image forming apparatus according to an example embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 200 according to an example embodiment of the present invention is described.

As illustrated in FIG. 1, the image forming apparatus 200 includes an apparatus body 50 and a duplexing unit 60.

The apparatus body 50 includes an intermediate transfer belt 11, image forming units 10*m*, 10*c*, 10*y*, and 10*k*, an optical write device 14, sheet feed trays 15*a* and 15*b*, sheet feed mechanisms 16*a* and 16*b*, a conveyance roller pair 17, a registration roller pair 18, a transfer opposing roller 13, a transfer exit guide 101, a fuser 20, switching pawls 21, 22, and 23, conveyance roller pairs 24, 25, 26, and 27, sheet sensors 35, 36, 37, 38, 39, 40, and 41, a sheet output roller pair 29, and a sheet output tray 30.

The duplexing unit 60 includes a switchback conveyance path 61, a sheet re-feed path 62, a first reversing roller pair 31, a second reversing roller pair 32, a manual feed tray 33, a manual feed mechanism 34, and a re-feed roller 28. For the apparatus body 50, the intermediate transfer belt 11 is provided in a substantially central portion thereof. The intermediate transfer belt 11 is looped over a plurality of rollers including the transfer opposing roller 13 and first transfer rollers 12.

The image forming units 10*m*, 10*c*, 10*y*, and 10*k* are disposed along a downward outer surface of the intermediate transfer belt 11 with respect to a vertical direction. Each of the image forming units 10*m*, 10*c*, 10*y*, and 10*k* has a photoconductor 1, a charger, a developer, and a cleaner. Each of the photoconductors 1 serves as an image carrying member, and is surrounded by the charger, the developer, and the cleaner.

Each of the first transfer rollers 12 is disposed along an inner circumferential surface of the intermediate transfer belt 11 so as to face the corresponding photoconductor 1. Each of the first transfer rollers 12 serves as a first transfer mechanism to transfer a toner image formed on the photoconductor onto the downward outer surface of the intermediate transfer belt 11.

According to the present example embodiment, the image forming units 10*m*, 10*c*, 10*y*, and 10*k* have a similar configuration except for colors handled in the developers. That is, the developers in the image forming units 10*m*, 10*c*, 10*y*, and 10*k* handle developing agents of magenta, cyan, yellow, and black colors, respectively.

Furthermore, in the present example embodiment, the image forming mechanisms 10*m*, 10*c*, 10*y*, and 10*k* are disposed in a color order of magenta, cyan, yellow, and black with respect to a traveling direction of the intermediate transfer belt 11, which indicated by an arrow A in FIG. 1. Each of the image forming units 10*m*, 10*c*, 10*y*, and 10*k* is configured as a replaceable cartridge, and is attachable to and is detachable from the apparatus body 50.

The optical write unit 14 is disposed under the image forming units 10*m*, 10*c*, 10*y*, and 10*k*. The optical write unit 14 includes a polygon mirror (not illustrated) and a group of mirrors (not illustrated). The optical write unit 14 emits a modulated laser beam onto a surface of the photoconductor 1 in each of the image forming units 10*m*, 10*c*, 10*y*, and 10*k*. The optical write unit 14 may be separately provided for each of the image forming units 10*r*, 10*c*, 10*y*, and 10*k*.

Incidentally, according to the present example embodiment, each of the intermediate transfer belt 11 and the optical write unit 14 is configured as a single unit, and is attachable to and detachable from the apparatus body 50.

The sheet feed trays 15*a* and 15*b* are disposed in two stages in a lower portion of the apparatus body 50. The sheet feed trays 15*a* and 15*b* store a recording member (hereinafter, referred to as a "sheet") such as a transfer sheet. The sheet feed trays 15*a* and 15*b* are also provided with the corresponding sheet feed mechanisms 16*a* and 16*b*, respectively.

Each of the sheet feed mechanisms 16*a* and 16*b* includes a pick-up roller, a supply roller, and a separation roller. The conveyance roller pairs 17 are provided so as to convey a sheet, which is fed with any one of the sheet feed mechanisms 16*a* and 16*b*.

The registration roller pair 18 is disposed above the conveyance roller pairs 17. That is, the registration roller pair 18 is disposed on a downstream side of the conveyance roller pairs 17 in a conveyance direction of the sheet.

The secondary transfer roller 100 is a roller member that serves as a secondary transfer mechanism. Specifically, the secondary transfer roller 100 transfers the toner image transferred on the intermediate belt 11 onto the sheet that has been conveyed from any one of the sheet feed trays 16*a* and 16*b*. The secondary transfer roller 100 is disposed above the registration roller pair 18 so as to face the transfer opposing roller 13. The transfer opposing roller 13 is looped with the intermediate transfer belt 11.

The transfer exit guide 101 is disposed at an adjacent position above the secondary transfer mechanism. The transfer exit guide 101 serves as a conveyance regulation member to regulate a conveyance direction of the sheet by contacting the sheet in conveyance. The fuser 20 is disposed on a downstream side of the transfer exit guide 101 in the sheet conveyance direction.

The switching pawls 21, 22, and 23 are disposed above the fuser 20 so as to switch directions in which the sheet is conveyed. Each of the switching pawls 21, 22, and 23 changes a position thereof from a position indicated by a full line in FIG. 2 to a position indicated by a-corresponding broken line. At this time, the position of each of the switching pawls 21, 22, and 23 is switched with an unillustrated actuator such as a solenoid.

Each of the conveyance rollers 24 to 27 is disposed in an appropriate position along sheet conveyance paths. Furthermore, each of the sheet sensors 35 to 41 is also disposed in an appropriate position along the sheet conveyance paths. Incidentally, a sheet is guided to an appropriate sheet conveyance path with guide members (not numbered) such as a guide plate.

The upper surface of the apparatus body 50 is configured to serve as the sheet output tray 30. The sheet output roller pair 29 is disposed diagonally upward left from the fuser 20 in FIG. 1. The sheet output roller pair 29 outputs a sheet to the sheet output tray 30.

According to the present example embodiment, the duplexing unit 60 is disposed at a side surface of the image forming apparatus 200. The duplexing unit 60 includes the switchback conveyance path 61 and the sheet re-feed path 62.

The first reversing roller pair 31 is disposed at an entrance portion of the switchback conveyance path 61. The entrance portion of the switchback conveyance path 61 is located in an upper portion of the image forming apparatus 200. Further, the second reversing roller pair 32 is disposed along the switchback conveyance path 61. The first reversing roller pair 31 and the second reversing roller pair 32 are configured to be rotatable in both clockwise and counterclockwise directions.

In addition, the conveyance roller pairs 26 and 27 are disposed at positions so as to substantially equally divide the sheet re-feed path 62 into three pieces. The switching pawl 23 is disposed at an adjacent position of the first reversing roller pair 31 so as to be located at an entrance portion from the switchback conveyance path 61 to the sheet re-feed path 62.

The manual feed tray 33 is configured to be housed into and ejected from a portion of an outer side surface of the duplexing unit 60. FIG. 1 illustrates a state where the manual feed tray 33 is ejected.

The manual feed mechanism 34 is provided to feed a sheet from the manual feed tray 33 to a sheet conveyance path. The manual feed mechanism 34 includes a pick-up roller, a supply roller, and a separation roller.

The re-feed roller 28 is disposed at a lateral side of the manual feed mechanism 34, that is, at a closer position to the apparatus body 50. Driven rollers are provided so as to contact with pressure an upper portion and an lower portion of the re-feed roller 28, respectively.

The re-feed roller 28 is configured to be rotatable in both clockwise and counterclockwise directions. When a sheet is re-fed from the sheet re-feed path 62, the re-feed roller 28 is rotated in the clockwise direction illustrated in FIG. 1. On the other hand, when a sheet is re-fed from the manual feed tray 33, the re-feed roller 28 is rotated in the counterclockwise direction illustrated in FIG. 1.

Below, an image forming operation is described for the image forming apparatus 200 configured as above.

Upon starting the image forming operation, the photoconductor 1 in each of the image forming units 10*m*, 10*c*, 10*y*, and 10*k*, is rotationally driven in a clockwise direction in FIG. 1 by an un-illustrated driving mechanism. A surface of the photoconductor 1 is uniformly charged with a given polarity by the charger.

The optical write unit 14 irradiates a laser beam onto the surface of the photoconductor 1 to form an electrostatic latent image thereon. At this time, original full-color image data is decomposed into single-color image data in magenta, cyan, yellow, and black. Then, the photoconductor 1 is exposed with the laser beam according to the decomposed single-color image data.

The electrostatic latent image formed on the surface of the photoconductor 1 is visualized with each color toner of magenta, cyan, yellow, and black in the developer.

The developer supplies each color toner of magenta, cyan, yellow, and black to the electrostatic latent image that has been formed on the surface of the photoconductor 1. Thus, the electrostatic latent image is visualized as a toner image in each color.

In each of the image forming units 10*m*, 10*c*, 10*y*, and 10*k*, the toner image in each color is sequentially transferred onto the surface of the intermediate transfer belt 11. At this time, the intermediate transfer belt 11 is rotationally driven in a counterclockwise direction as indicated by the arrow A in FIG. 1. Therefore, the toner images in magenta, cyan, yellow and black are sequentially superimposed on the surface of the intermediate transfer belt 11. Thus, the intermediate transfer belt 11 carries a full-color toner image on the surface thereof.

Incidentally, the image forming apparatus 200 may form a single-color image by using any one of the image forming units 10*m*, 10*c*, 10*y*, and 10*k*. The image forming apparatus 200 may also form a color image by using any two or three of the image forming units 10*m*, 10*c*, 10*y*, and 10*k*. In monochrome image forming, the image forming apparatus 200 uses only the image forming unit 10*k*.

After all of the toner images are transferred onto the intermediate transfer belt 11, the cleaner in each of the image forming units 10*m*, 10*c*, 10*y*, and 10*k* removes excess toner remaining on the surface of the photoconductor 1. Then, the surface of the photoconductor 1 is discharged with an unillustrated discharger so that a surface potential of the photoconductor 1 is initialized in preparation for a subsequent image forming operation.

Meanwhile, a sheet is selectively fed from any one of the sheet feed tray 15*a*, the sheet feed tray 15*b*, and the manual feed tray 33. The sheet is sent out to the secondary transfer mechanism by the registration roller pair 18 so as to match a timing when the full-color toner image carried on the intermediate transfer belt 11 is conveyed to the secondary transfer mechanism.

According to the present example embodiment, the secondary transfer roller 100 is applied with a transfer voltage having an opposite polarity to a polarity with which the full-color toner image on the intermediate transfer belt 11 is charged. Thereby, the full-color toner image is collectively transferred onto the sheet.

While the sheet on which the full-color toner image has been transferred passes through the fuser 20, the full-color toner image is fused and is fixed on the sheet. After the fusing process, the sheet is output to the sheet output tray 30, which is disposed on the upper surface of the apparatus body 50.

Figure 2:
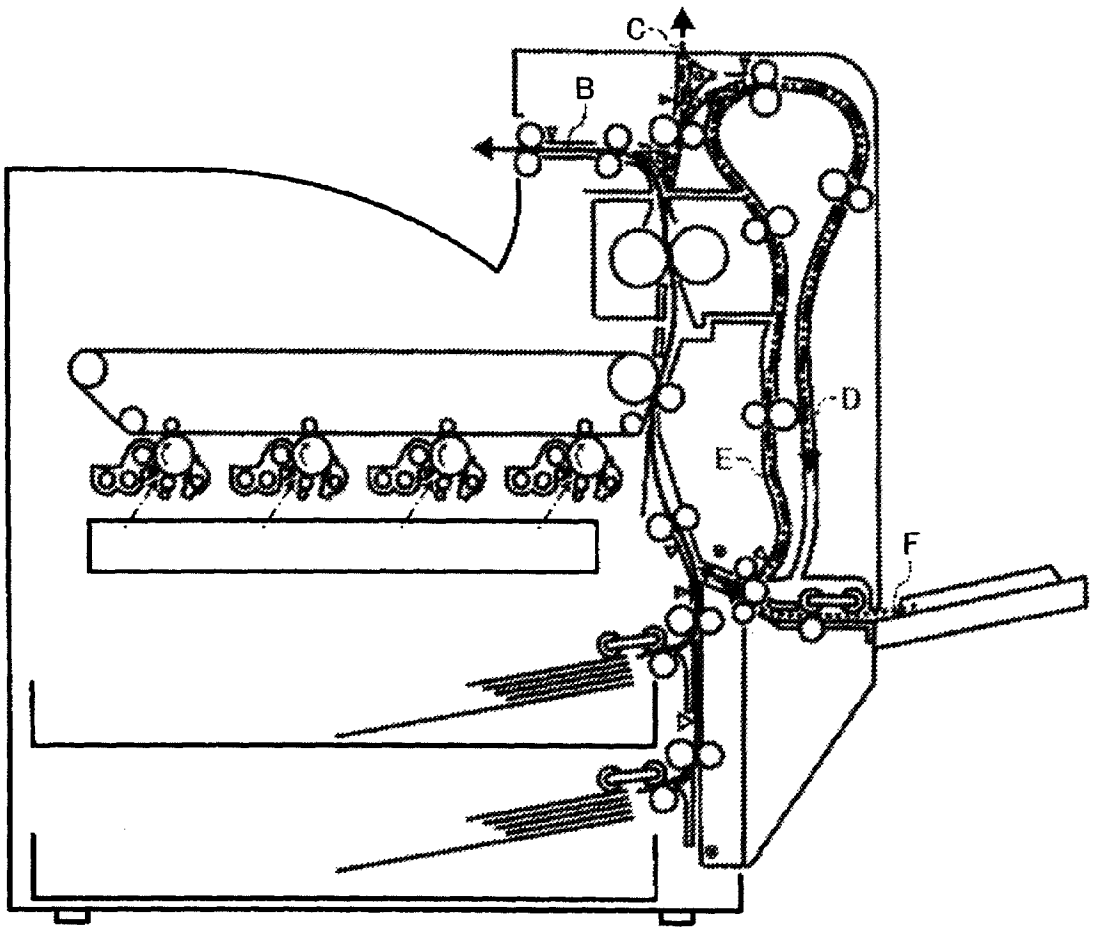
FIG. 2 is an explanatory diagram illustrating conveyance paths in the image forming apparatus of FIG. 1.

For a single-sided operation, a thick solid line B illustrated in FIG. 2 indicates a sheet conveyance route from the sheet feed trays 15*a* and 15*b*.

An optional sheet output tray (not illustrated), such as a four-compartment sorting tray, may be configured to be attachable on the upper surface of the apparatus body 50 above the switching pawl 22. Thus, after the fusing process, the sheet may be output to the optional sheet feed tray. For this case, a thick broken line C in FIG. 2 indicates a sheet conveyance route after the sheet passes through the fuser 20.

For a double-sided operation, a full-color toner image is transferred on one surface of a sheet, and then the sheet is sent out into the switchback conveyance path 61 by appropriately switching the positions of the switching pawls 21, 22, and 23.

At this time, each position of the switching pawls 21 and 22 is changed from a position indicated by a thick solid line in FIG. 2 to a position indicated by a thin broken line in FIG. 2. The position of the switching pawl 23 is changed from a position indicated by a thin broken line in FIG. 2 to a position indicated by a thick solid line in FIG. 2. The reversing roller pairs 31 and 32 are rotated in an clockwise direction in FIG. 2.

When the sheet is sent out into the switchback conveyance path 61, a sheet conveyance route after passing through the conveyance roller pair 25 is indicated by a chain double-dashed line D in FIG. 2.

When the sheet sensor 40 detects a trailing edge of the sheet that has been sent into the switchback conveyance path 61, the reversing roller pairs 31 and 32 are reversely rotated in clockwise directions in FIG. 2, thereby reversing the sheet conveyance direction of the sheet. Then, the position of the switching pawl 23 is changed to the position indicated by a thin broken line in FIG. 2, and the sheet is sent out into the re-feed path 62.

The re-feed path 62 merges with the sheet conveyance path from the manual sheet feed tray 33 at the lower end thereof. The re-feed path 62 also merges with the sheet conveyance path from the sheet feed trays 15*a* and 15*b* at an inner side of the re-feed roller 28 relative to the center of the apparatus body 50. The sheet is conveyed through the re-feed path 62 with the conveyance roller pairs 26 and 27, and is then conveyed to the registration roller pair 18 with the re-feed roller 28.

For the case when the sheet is conveyed through the re-feed path 62, a single-dashed line E in FIG. 2 indicates a sheet conveyance route from the switching pawl 23 to the joint point with the thick solid line B. Further, for the case when a sheet is fed from the manual feed tray 33, a dashed line F in FIG. 2 indicates a sheet conveyance path from the manual feed tray 33 to a position immediately after passing through the re-feed roller 28.

The sheet is reversed upside down by passing through the re-feed path 62 relative to the surface on which the intermediate transfer belt 11 carries a full-color toner image. Then, the full-color toner image is transferred from the intermediate transfer belt 11 onto the opposite surface of the sheet.

The transferred full-color image is fixed on the opposite surface of the sheet with the fuser, causing the sheet to carry the full-color toner images on both of the surfaces thereof. The resultant sheet is output to the sheet output tray 30 or the un-illustrated optional tray, and thus the dual-sided printing operation is finished.

Figure 3:
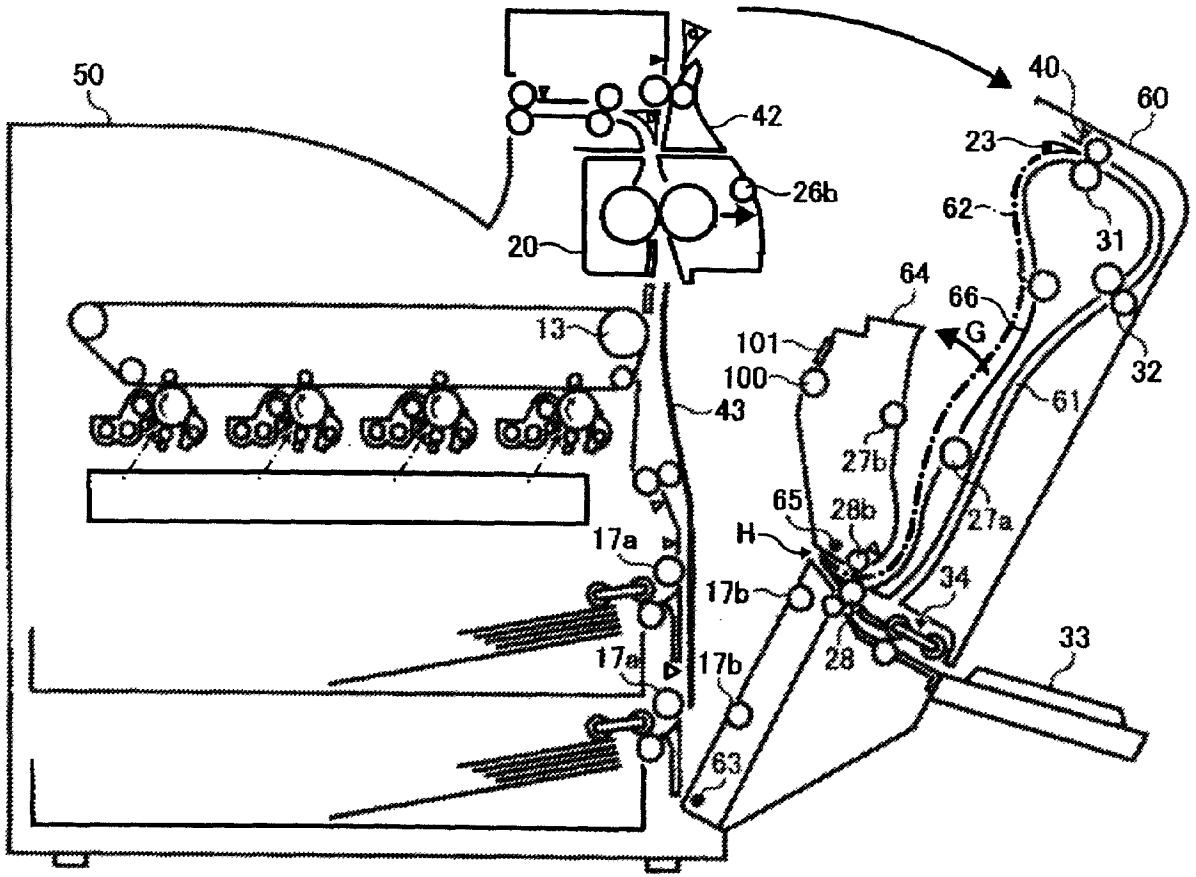
FIG. 3 is an explanatory diagram illustrating open and close operations of the duplexing unit included in the image forming apparatus of FIG. 1.

According to the present example embodiment, the duplexing unit 60 is attached to the apparatus body 50 so as to be swayed by using a rotating shaft 63 as a pivot. Therefore, the duplexing unit 60 is openable and closable with respect to the apparatus body 50. FIG. 3 illustrates a state where the duplexing unit 60 is opened.

In addition, the duplexing unit 60 is supported by an un-illustrated link mechanism so as to be stopped at an appropriate position at opening. At this time, an open angle is preferably in a range of about 45 degrees to about 90 degrees, from a viewpoint of efficiency in a below-described replacement operation of the secondary transfer roller. The link mechanism, which supports the duplexing unit 60, is preferably provided with a damper mechanism so that a required force may be reduced in opening and closing of the duplexing unit 60. The damper mechanism may include a spring damper or an oil damper.

Further, as openable and closable members relative to the apparatus body 50, the duplexing unit 60 includes guide plates (not numbered) forming the switchback conveyance path 61, a guide member 66 forming a part of the re-feed path 62, a supplementary rotation unit 64, driven rollers 17*b* of the conveyance roller pairs 17, in addition to the switching pawl 23, the reversing roller pairs 31 and 32, the manual feed tray 33, the manual feed mechanism 34, and the re-feed roller 28.

The supplementary rotation unit 64 is configured to be rotatable around a rotation shaft 65 serving as a fulcrum shaft. The supplementary rotation unit 64 supports the secondary transfer roller 100, a driven roller 27*b* of the conveyance roller pair 27, a driven roller 26*b* of the re-feed roller 28, and the sheet sensor 41 (shown in FIG. 1).

Therefore, the re-feed path 62 is openable by rotating the supplementary rotation unit 64 in a counterclockwise direction G in FIG. 3. A rotation angle of the supplementary rotation unit 64 in the counterclockwise direction G is limited with an un-illustrated stopping member approximately up to an angle as illustrated in FIG. 3.

The re-feed path 62 is defined on one side (the right side in FIG. 3) thereof with the guide member 66, and on the other side (the left side in FIG. 3) thereof with the guide member 42, the fuser 20, and the supplementary rotation unit 64. When the duplexing unit 60 is closed to the apparatus body 50, the re-feed path 62 is formed with the above members.

When the duplexing unit 60 is closed to the apparatus body 50 as illustrated FIG. 1, the supplementary rotation unit 64 is set to a given position by being sandwiched with the apparatus body 50 and the duplexing unit 60. The secondary transfer roller 100 is contacted to the intermediate transfer belt 11 with pressure so as to face the transfer opposing roller 13. The respective driven rollers 17*b* of the conveyance roller pairs 17 are contacted to the corresponding drive rollers 17*a* with pressure. The driven roller 27*b* of the conveyance roller pair 27 is contacted to the drive roller 27*a* with pressure. Thus, the duplexing unit 60 becomes operable.

On the other hand, when the duplexing unit 60 is opened from the apparatus body 50, the secondary transfer roller 100 is separated from a portion of the intermediate transfer belt 11 which the transfer opposing roller 13 contacts with pressure. Further, the respective driven rollers 17*b* of the conveyance roller pairs 17 are separated from the corresponding drive rollers 17*a*. Thus, an ordinary sheet conveyance path 43, which is indicated by a thick solid line in FIG. 3, is opened in an area from the lower conveyance roller pair 17 to the fuser 20.

At this time, when the supplementary rotation unit 64 is rotated in a direction in which the re-feed path 62 is opened, that is, in the counterclockwise direction G in FIG. 3, the re-feed path 62 is opened from the switching pawl 23 to a merging point H, a point at which the re-feed path 62 merges with the ordinary sheet conveyance path 43.

Next, a configuration of the secondary transfer roller 100 of FIG. 1 is described in more detail with reference to FIGS. 4 to 6.

Figure 4:
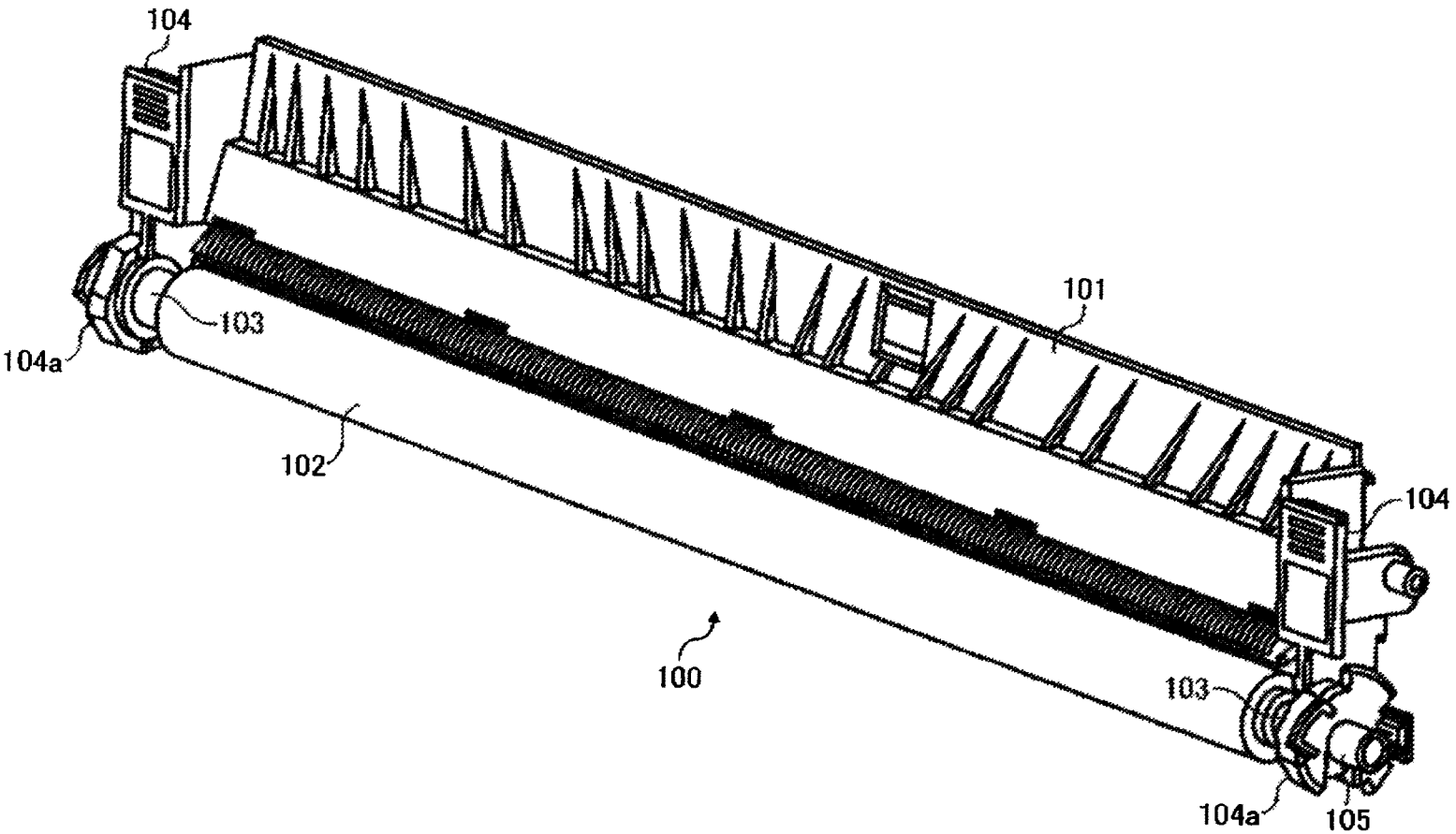
FIG. 4 is an appearance perspective diagram illustrating a secondary transfer roller attachable to and detachable from the image forming apparatus of FIG. 1.

FIG. 4 is an appearance perspective diagram of the secondary transfer roller 100 that is attachable to and detachable from the supplementary rotation unit 64 (shown in FIG. 1). According to the present example embodiment, the secondary transfer roller 100 includes a roller portion 102 and two shaft end portions 103 thereof. The roller portion 102 may be an elastic body formed on an outer circumferential surface of a metal core. The shaft end portions 103 may be end portions of the metal core that are projected outward from ends of the roller portion 102 in a rotation axis direction-of the roller portion 102.

Figure 9:
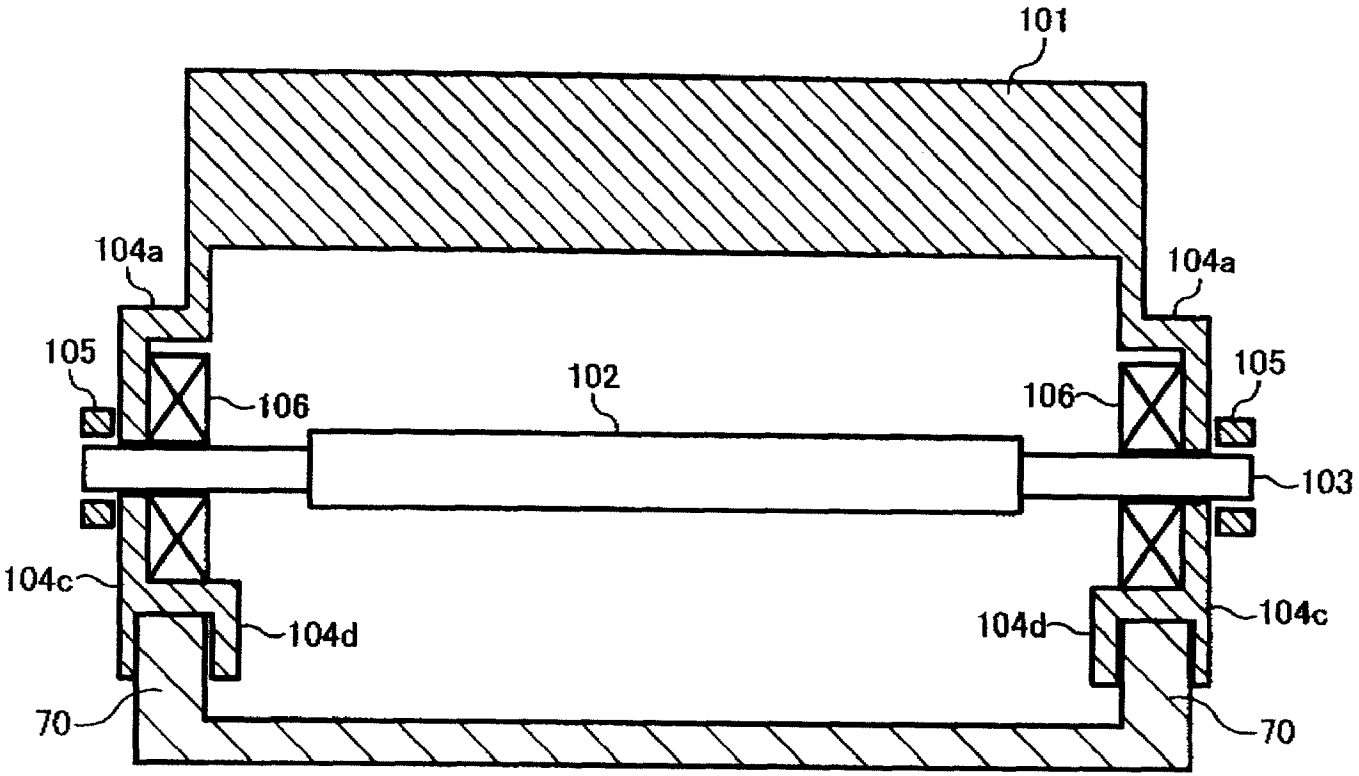
FIG. 9 is an explanatory diagram illustrating a cross section of the secondary transfer roller of FIG. 4 attached to the supplementary rotation unit, parallel to the rotation axis direction of the roller portion.

Further, a roller attachment part 104*a* of a gripper 104 may be rotatably attached to each of the shaft end portions 103 via an un-illustrated ball bearing member (refer to 106 in FIG. 9). The gripper 104 serves as a handgrip and is integrally formed with-the transfer exit guide 101, which serves as a conveyance regulation member. The transfer exit guide 101 may also serve as a handgrip member.

According to the present example embodiment, the transfer exit guide 101 and the gripper 104 are integrally molded ABS (acrylonitrile butadiene styrene) resin. Materials of the transfer exit guide 101 and the gripper 104 are not limited to ABS resins, and may include PC (polycarbonate) resins and other resins.

However, members made of ABS resin generally have relatively high flexibility compared to members made of PC resin or AS (acrylonitrile styrene) resin. Thus, when the roller attachment part 104*a* of the gripper 104 is attached to and detached from the end portions of the metal core forming the shaft end portion 103 in the secondary transfer roller 100, the members made of ABS resin generally have relatively high resistance to damage and therefore are easier to handle compared to the members made of PC resins or AS resins.

On the other hand, from a viewpoint of sheet guide performance, the transfer exit guide 101 is preferably made of a resin that does not contain any butadiene component. One reason is that when the transfer exit guide 101 is made of a resin containing butadiene component, a charged amount of the transfer exit guide 101 resulting from friction with a sheet may be increased, thereby disturbing a toner image that is not still fixed on the sheet.

Incidentally, although the gripper 104 and the transfer exit guide 101 are integrally molded in the present example embodiment, the gripper 104 and the transfer exit guide 101 may be configured as separate members and then be fixed with each other.

The shaft end portions 103 of the secondary transfer roller 100 are also projected outward from the roller attachment parts 104*a* in the rotation axis direction of the roller portion 102.

Caps 105 serving as a cap-shaped shaft bearing member are attached to the projected portions of the shaft end portions 103. The caps 105 are fixed by being sandwiched with un-illustrated sandwiching members serving as roller support members. The un-illustrated sandwiching members are provided in the intermediate transfer unit including the intermediate transfer belt 11. Thus, a position of the secondary transfer roller 100 is fixed with respect to a vertical direction of the apparatus body 50 (shown in FIG. 1).

The caps 105 may be made of polyacetal resin or other resin having a relatively low friction coefficient with an outer circumferential surface of the shaft end portion 103. Accordingly, even when the cap 105 is sandwiched with the sandwiching members, a relatively low friction is obtained between an inner circumferential surface of the cap 105 and the outer circumferential surface of the metal core of the shaft end portion 103. Thus, the secondary transfer roller 100 becomes rotatable with relatively low load.

Figure 5:
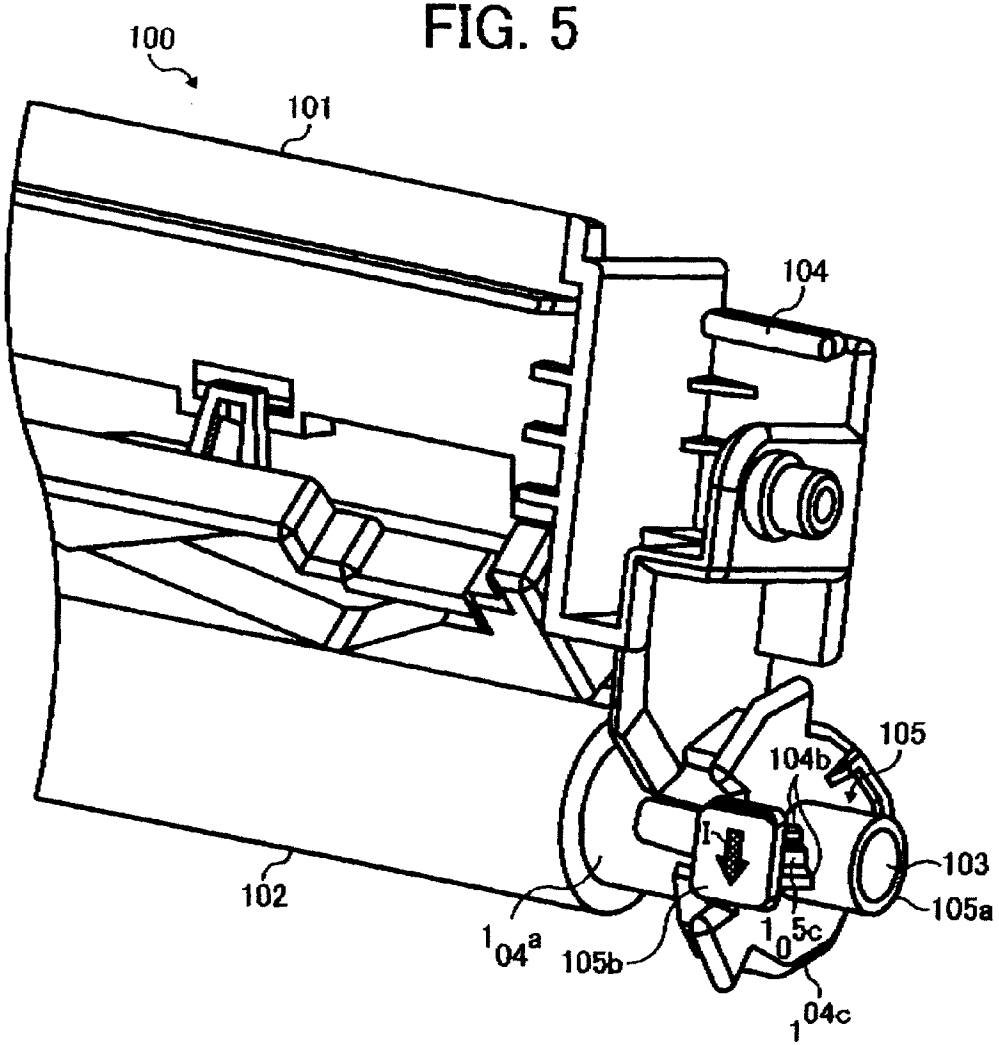
FIG. 5 is an enlarged diagram illustrating an edge portion of the secondary transfer roller of FIG. 4.

FIG. 5 is an enlarged diagram illustrating an end portion of the secondary transfer roller 100 shown in FIG. 4. In FIG. 5, the end portion of the left side in the secondary transfer roller 100 of FIG. 4 is enlarged. The secondary transfer roller 100 is viewed from the side facing the supplementary rotation unit 64 (shown in FIG. 3) when the secondary transfer roller 100 is attached to the supplementary rotation unit 64.

As illustrated in FIG. 5, the cap 105 includes a cap body 105*a*, a marked member 105*b*, and a connecting member 105*c*. The cap body 105*a* has a cylindrical shape including an inner hollow into which the shaft end portion 103 is inserted. The marked member 105*b* includes an arrow I indicating a direction in which the secondary transfer roller 100 is attached to the supplementary rotation unit 64. The connecting member 105*c* is extended from an outer circumferential surface of the cap body 105*a* outward in a radial direction of the cap body 105*a*. The marked member 105*b* is connected to the cap body 105*a* with the end portion of the connecting member 105*c*.

According to the present example embodiment, as described below, while the transfer exit guide 101 is kept above the roller portion 102 with respect to a vertical direction of the apparatus body 50, the secondary transfer roller 100 is moved vertically downward to the supplementary rotation unit 64. Thus, the secondary transfer roller 100 is attached to the supplementary rotation unit 64. As illustrated in FIG. 5, the arrow I indicating the attachment direction is formed on a plain surface of the marked member 105*b*.

According to the present example embodiment, a fixing member is provided to fix the cap 105 into the roller attachment part 104*a* of the gripper 104 and to suppress unintended detachment of the cap 105 from the shaft end portion 103. The fixing member includes the connecting member 105*c* that serves as an engaging part of the cap 105, and sandwiching members 104*b* that serve as an engaged part disposed at an outer side of each of the roller attachment parts 104*a* in the rotation axis direction of the roller portion.

When the cap 105 is attached to the shaft end portion 103 from an outer side of the shaft end portion 103 in the rotation axis direction of the roller portion, the connecting member 105*c* is sandwiched with the sandwiching members 104*b* of the roller attachment part 104*a*. Thus, the cap 105 is fixed to the roller attachment part 104*a* in a so-called snap-fit manner.

For the secondary transfer roller 100 having the configuration as described above, when an operator, such as a user or technical service staff, performs a replacement operation of the secondary transfer roller 100, the operator can grip the grippers 104 disposed at the ends of the secondary transfer roller 100 with both hands, or grip the transfer exit guide 101 with a single hand or both hands.

In the secondary transfer roller 100, the gripper 104 and the transfer exit guide 101 are disposed at positions so as to be easily gripped by the operator, compared to the roller portion 102 and the shaft end portion 103. Further, the gripper 104 and the transfer exit guide 101 are configured in shapes that can be easily gripped by the operator, compared to the roller portion 102 and the shaft end portion 103.

Accordingly, the operator can handle the secondary transfer roller 100 by griping the gripper 104 or the transfer exit guide 101 in the replacement operation of the secondary transfer roller 100. As a result, it is less likely that the operator handles the secondary transfer roller 100 by gripping the roller portion 102 or the shaft end portion 103.

Thus, attachment of dirt from the operator's hand to a surface of the roller portion 102 may be reduced, thereby suppressing degradation in sheet conveying performance of the secondary transfer roller 100 and degradation in image quality due to unevenness of an electric field in the second transfer area. In addition, as described below, operation efficiency may be increased when the roller attachment part 104*a* of the gripper 104 is inserted into a roller receiving part provided in the supplementary rotation unit 64.

Figure 6A:
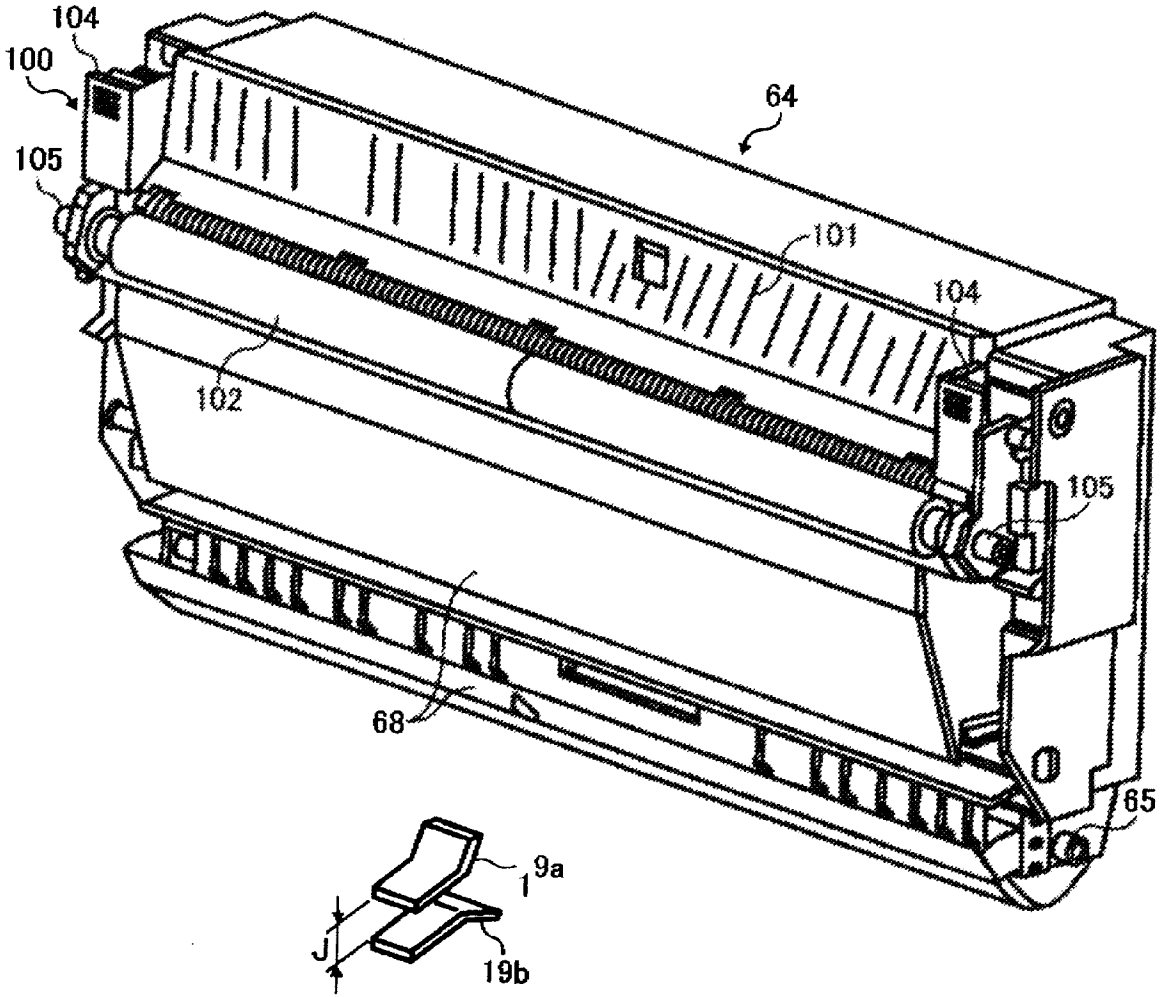
FIG. 6A is a perspective diagram illustrating a supplementary rotation unit provided in the duplexing unit of FIG. 3.
Figure 6B:
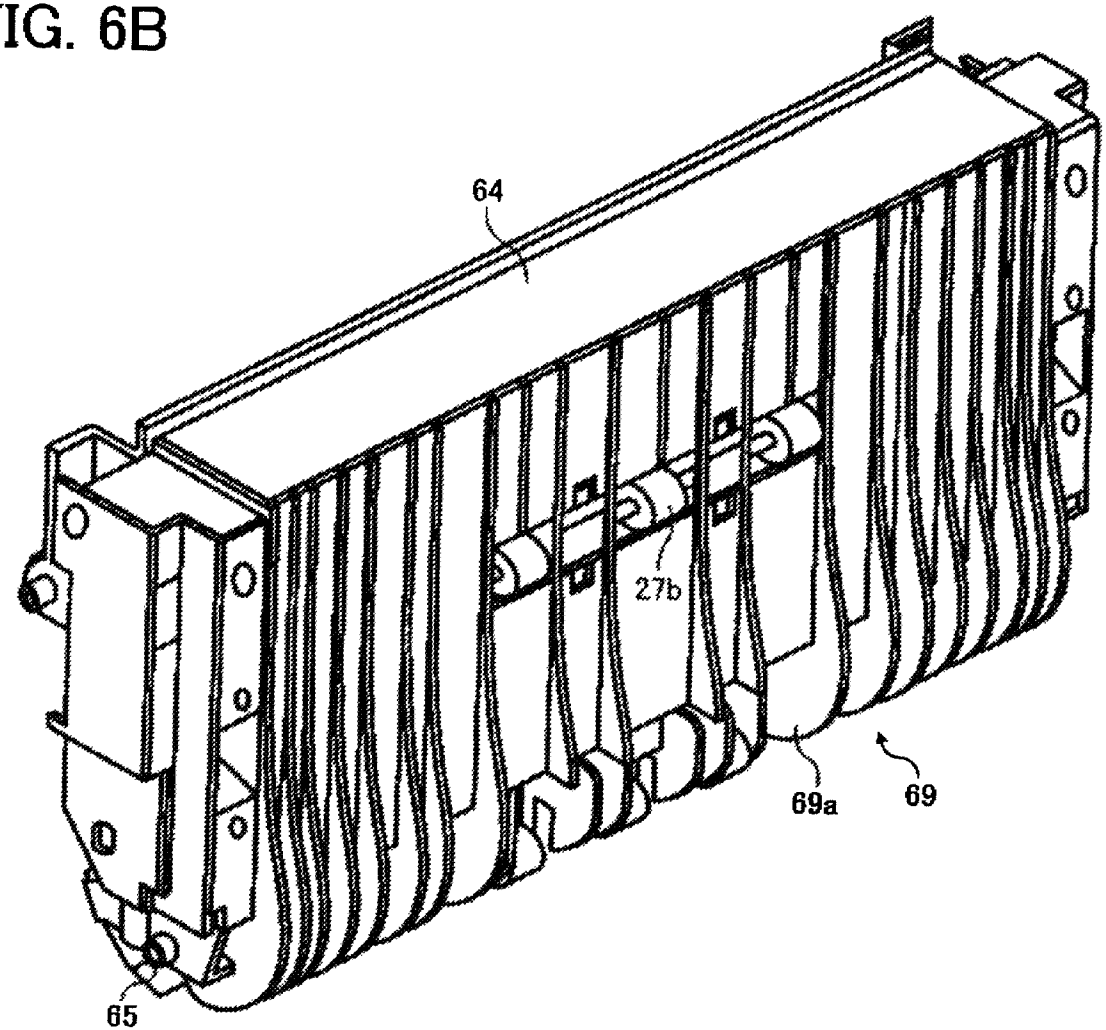
FIG. 6B is a perspective diagram illustrating the supplementary rotation unit of FIG. 6A, seen from another angle.

FIG. 6A and FIG. 6B are appearance perspective diagrams illustrating the supplementary rotation unit 64 with the secondary transfer roller 100 attached thereto. In FIG. 6A, the supplementary rotation unit 64 is viewed from the side of the apparatus body 50. In FIG. 6B, the supplementary rotation unit 64 is viewed from the side of the re-feed path 62.

According to the present example embodiment, while the secondary transfer roller 100 is attached to the supplementary rotation unit 64, the roller attachment part 104*a* (shown in FIG. 5) of the gripper 104 of the secondary transfer roller 100 is supported with the roller receiving part 70 (shown in FIG. 8A) provided in the supplementary rotation unit 64 so as to serve as a grip holding member.

In the apparatus body 50, sandwiching members 19*a* and 19*b* are provided at respective positions corresponding to the caps 105 that are attached to the end portions of the secondary transfer roller 100. The sandwiching members 19*a* and 19*b* serve as positioning members to define a position of the secondary transfer roller 100 on an imaginary plane perpendicular to a swaying direction of the duplexing unit 60 when the duplexing unit 60 is closed to the apparatus body 50.

Incidentally, FIG. 6A illustrates only the sandwiching members 19*a* and 19*b* disposed at the right side of the supplementary rotation unit 64. An interval between the sandwiching members 19*a* and 19*b* is extended in a tapered shape in respective fore end portions thereof, and is configured in a parallel shape having an interval length J in accordance with an outer diameter of the cap body 105*a* of the cap 105.

When the secondary transfer roller 100 is attached to the supplementary rotation unit 64, the secondary transfer roller 100 is fixed to the supplementary rotation unit 64 in a so-called snap-fit manner so that a sheet guide surface of the transfer exit guide 101 provided in the secondary transfer roller 100 is in line with the ordinary sheet conveyance path 43 (refer to FIG. 3) when the duplexing unit 60 is closed to the apparatus body 50.

Further, as illustrated in FIG. 6A, a transfer entrance guide plate 68 is disposed in a closer side of the supplementary rotation unit 64 to the apparatus body 50 and under the secondary transfer roller 100. The transfer entrance guide plate 68 is configured to form a part of the ordinary sheet conveyance path 43 together with the opposing guide plate (refer to FIGS. 1 and 3, although not numbered) disposed in the side of the apparatus body 50.

As illustrated in FIG. 6B, a closer side of the supplementary rotation unit 64 to the re-feed path 62 is configured as a conveyance guide surface 69 having a plurality of ribs 69*a*. The supplementary rotation unit 64 is also configured to form a part of the re-feed path 62 together with the opposing guide member 66 (refer to FIG. 3).

Next, a replacement operation of the secondary transfer roller 100 is described with reference to FIG. 7.

Figure 7:
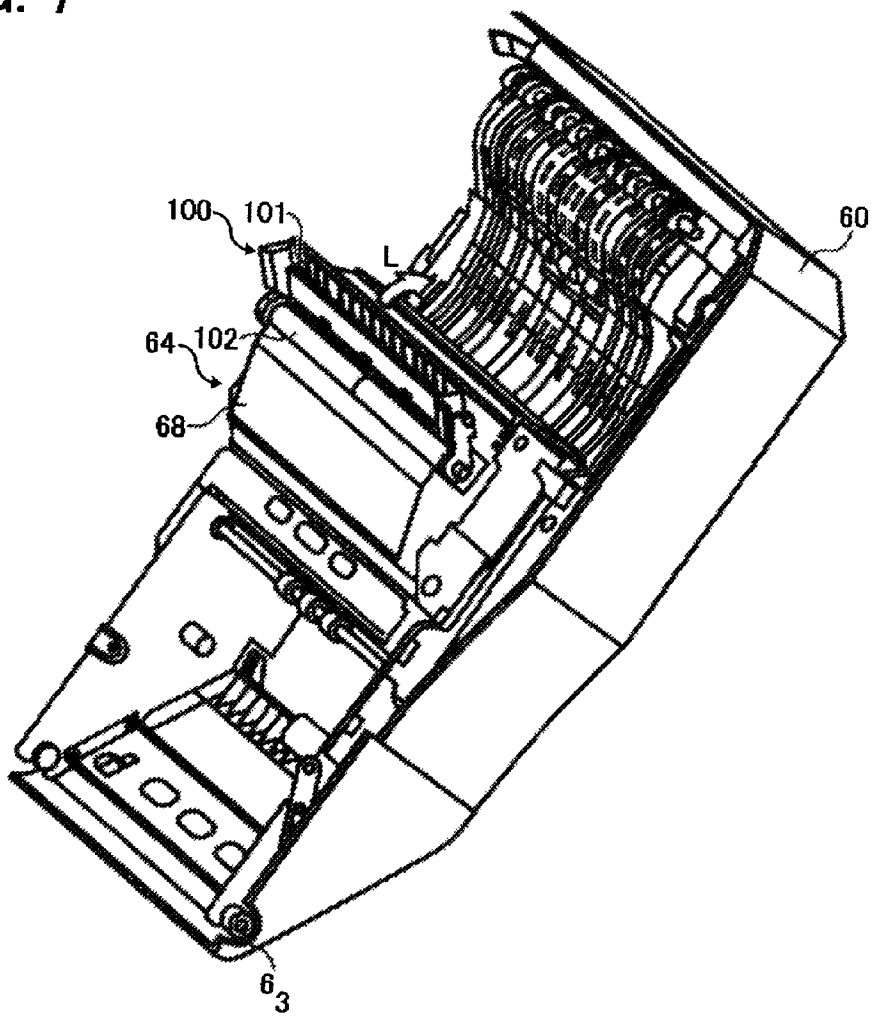
FIG. 7 is an explanatory diagram illustrating operation directions of the secondary transfer roller of FIG. 4 when the secondary transfer roller is attached to the supplementary rotation unit.

FIG. 7 is an explanatory diagram illustrating an operation direction of the secondary transfer roller 100 when the secondary transfer roller 100 is attached to the supplementary rotation unit 64.

For a replacement operation of the secondary transfer roller 100, first, an operator opens the duplexing unit 60 from the apparatus body 50, and exposes an interior of the supplementary rotation unit 64. At this time, the secondary transfer roller 100 is still attached to the supplementary rotation unit 64 in the snap-fit manner, as described above.

Then, the operator grips and moves the transfer exit guide 101 or the gripper 104 (shown in FIG. 4) toward the apparatus body 50, that is, in a direction opposite to a direction indicated by an arrow L in FIG. 7. Thereby, the secondary transfer roller 100 is detached from the supplementary rotation unit 64. Thus, the secondary transfer roller 100 becomes rotatable while the roller attachment part 104*a* of the gripper 104 is supported with the roller receiving part 70 of the supplementary rotation unit 64.

Further, the operator rotates the secondary transfer roller 100 until the sheet guide surface of the transfer exit guide 101 becomes parallel to a substantially vertical plane. Then, the operator pulls up the secondary transfer roller 100 in a substantially vertical direction, while gripping the transfer exit guide 101 or the gripper 104. Thereby, the roller attachment part 104*a* of the gripper 104 is disengaged from the roller receiving part 70. Thus, the secondary transfer roller 100 is detached from the supplementary rotation unit 64.

After detaching the secondary transfer roller 100 from the supplementary rotation unit 64, the operator attaches a replacement secondary transfer roller 100 to the supplementary rotation unit 64 in a procedure substantially opposite to the above-described detachment procedure.

On attaching the replacement secondary transfer roller 100, the operator generally stands facing a side at which the duplexing unit 60 is disposed in the image forming apparatus 200. Therefore, when the operator grips the transfer exit guide 101 or the gripper 104 to attach the replacement secondary transfer roller 100 to the supplementary rotation unit 64, the operator looks at the front, towards a surface (i.e. a back surface in FIG. 4) of the replacement secondary transfer roller 100 that is faced to the supplementary rotation unit 64.

Then, while gripping the transfer exit guide 101 or the gripper 104 of the replacement secondary transfer roller 100, the operator attaches the replacement secondary transfer roller 100 to the supplementary rotation unit 64 from an upper side of the supplementary rotation unit 64 in a vertical direction. Thus, the roller attachment part 104*a* of the gripper 104 is engaged with the roller receiving part 70 of the supplementary rotation unit 64.

At this time, the operator can see an attachment direction of the replacement secondary transfer roller 100 to the supplementary rotation unit 64 by checking the arrow I, which is formed on the marked member 105*b* to indicate the attachment orientation. Also, according to the present example embodiment, the arrow I is provided at an adjacent position of the roller attachment part 104*a* that is engaged with the roller receiving part 70 of the supplementary rotation unit 64. Thereby, the arrow I becomes noticeable to the operator, suppressing overlook thereof.

In addition, according to the present example embodiment, a similar arrow (not illustrated) to the arrow I is provided at an adjacent position of the roller receiving part 70 of the supplementary rotation unit 64. Specifically, the similar arrow is provided at a position opposite to a position at which the arrow I is located in the replacement secondary transfer roller 100 when the roller attachment part 104*a* of the gripper 104 is properly engaged with the roller receiving part 70 of the supplementary rotation unit 64.

Accordingly, on attaching the replacement secondary transfer roller 100 to the supplementary rotation unit 64, the operator can engage the roller attachment part 104*a* with the roller receiving part 70 of the supplementary rotation unit 64 through properly locating the arrow I and the similar arrow relative to each other. Thus, the replacement secondary transfer roller 100 can be properly attached to the supplementary rotation unit 64.

During the above attachment operation of the replacement secondary transfer roller 100, the operator performs the attachment, operation while checking positions of the roller attachment part 104*a* of the gripper 104 and the roller receiving part 70 of the supplementary rotation unit 64, in addition to positions of the arrow I and the similar arrow.

Accordingly, as in the present example embodiment, providing the arrow I and the similar arrow at respective adjacent positions of the roller attachment part 104*a* and the roller receiving part 70 may reduce the number of times when the operator changes gaze direction. As a result, operation efficiency may be increased in the replacement operation.

Figure 8B:
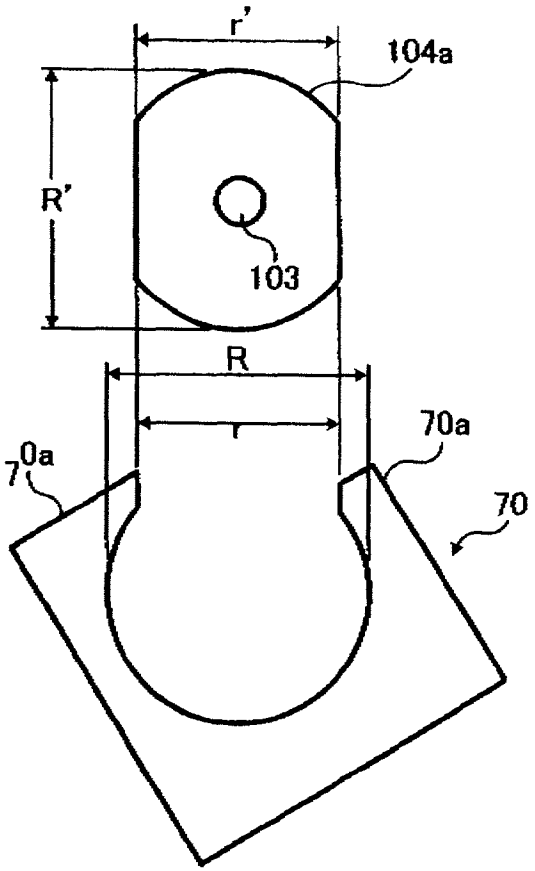
FIG. 8B is an explanatory diagram illustrating cross sections of the roller receiving part of FIG. 6A and the roller attachment part of FIG. 4, perpendicular to a rotation axis direction of the roller portion.
Figure 8A:
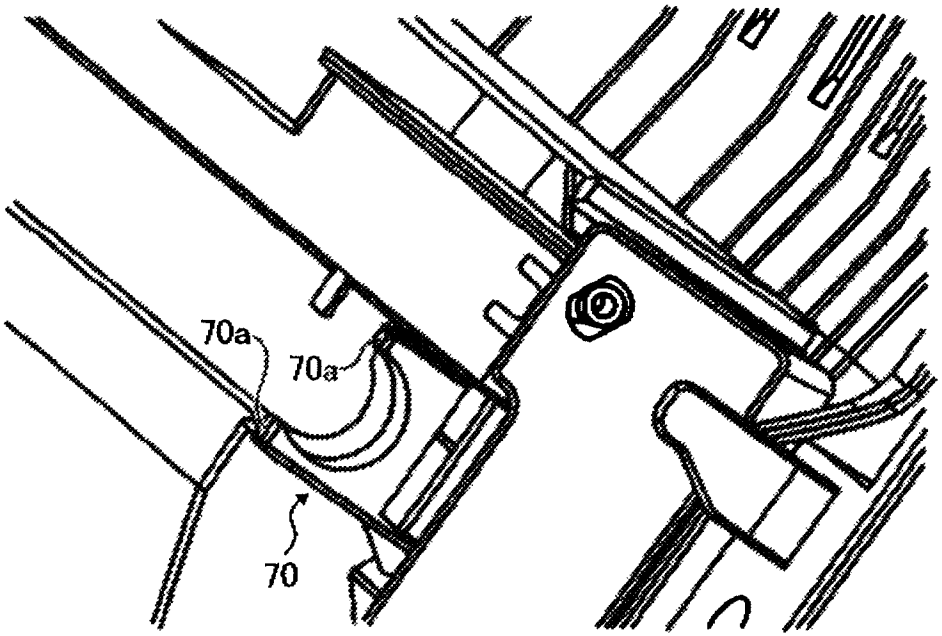
FIG. 8A is an enlarged perspective diagram illustrating a roller receiving part of the supplementary rotation unit of FIG. 6A with the secondary transfer roller detached therefrom.

FIGS. 8A and 8B illustrate an engaging point between the roller attachment part 104*a* of the gripper 104 and the roller receiving part 70 of the supplementary rotation unit 64 in the secondary transfer roller 100. FIG. 8A is an enlarged perspective diagram illustrating the roller receiving part 70 of the supplementary rotation unit 64 with the secondary transfer roller 100 detached therefrom. FIG. 8B is an explanatory diagram illustrating cross-sectional planes of the roller receiving part 70 and the roller attachment part 104*a*, perpendicular to a rotation axis direction of the roller portion 102.

According to the present example embodiment, the roller attachment part 104*a* of the gripper 104 is attached to the shaft end portion 103 of the secondary transfer roller 100. The roller attachment part 104*a* has a shape in which two circular arc portions are removed from a member having a circular-shaped cross section and a diameter R' so that two chords thereof becomes parallel to each other, as illustrated in FIG. 8B.

On the other hand, the roller receiving part 70 provided in the supplementary rotation unit 64 has substantially a U-shape in a cross section thereof, as illustrated in FIG. 8B. The U-shape is narrowed in an open portion thereof. An inner space of the U-shape has a shape in which a part of a circular arc is removed from a cross sectional circular having a diameter R slightly larger than a diameter R', that is, a maximum dimension of the roller attachment part 104*a*.

An opening dimension r of the open portion of the roller receiving part 70 is configured to be slightly larger than a minimum dimension r' indicating a distance between the two chords of the roller attachment part 104*a*, and to be sufficiently smaller than the maximum dimension R' of the roller attachment part 134*a*. Consequently, the roller attachment part 104*a* can be engaged into the roller receiving part 70 when the roller attachment part 104*a* takes an orientation as illustrated in FIG. 8B relative to the roller receiving part 70.

According to the present example embodiment, when an orientation of the secondary transfer roller 100 is held so that the sheet guide surface of the transfer exit guide 101 is parallel to a substantially vertical plane, the roller attachment part 104*a* has an orientation as illustrated in FIG. 8B. Further, when the duplexing unit 60 is opened up to a given position, the open portion of the roller receiving part 70 is oriented upward in a substantially vertical direction, as illustrated in FIG. 8B.

Accordingly, the operator first holds the supplementary rotation unit 64 of the duplexing unit 60, which is opened up to the given position, so that the sheet guide surface of the roller attachment part 104*a* becomes parallel to a substantially vertical plane. Then, the operator moves the secondary transfer roller 100 to the supplementary rotation unit 64 so that the roller attachment part 104*a* is inserted into the roller receiving part 70 from just above the open portion of the roller receiving part 70 in a substantially vertical direction. Thus, the roller attachment part 104*a* of the secondary transfer roller 100 is engaged with the roller receiving part 70 of the supplementary rotation unit 64.

The maximum dimension R' of the roller attachment part 104*a* is configured to be slightly smaller than the minimum dimension R of the inner space of the roller receiving part 70, as described above. Therefore, the secondary transfer roller 100 is rotatable when the roller attachment part 104*a* thereof is engaged with the roller receiving part 70 of the supplementary rotation unit 64.

Then, while gripping the transfer exit guide 101 or the gripper 104, the operator rotates the secondary transfer roller 100 in a direction so that the transfer exit guide 101 is moved away from the apparatus body 50. Further, the operator pushes the transfer exit guide 101 or the gripper 104 against the supplementary rotation unit 64 to fix the secondary transfer roller 100 to the supplementary rotation unit 64 in the snap-fit manner. Finally, the operator closes the duplexing unit 60 relative to the apparatus body 50 to finish the replacement operation of the secondary transfer roller 100.

On attaching the replacement secondary transfer roller 100, as described above, the operator performs positioning of the secondary transfer roller 100 relative to the supplementary rotation unit 64 so that the arrow I of the secondary transfer roller 100 and the similar arrow of the supplementary rotation unit 64 have proper positions relative to each other. In this regard, if no mechanism is provided to support the positioning, the operation efficiency in the above attachment operation may be decreased. Therefore, according to the present example embodiment, the image forming apparatus 200 is configured to have a positioning mechanism as follows.

FIG. 9 is an explanatory diagram illustrating a cross-section of the secondary transfer roller 100, which is attached to the supplementary rotation unit 64, parallel to the rotation axis direction of the roller portion 102.

As illustrated as in FIG. 9, according to the present example embodiment, guide pieces 104*c* and 104*d* are provided for each of the roller attachment parts 104*a* at positions adjacent to an outer side and an inner side, respectively, thereof in the rotation axis direction of the roller portion 102. The guide pieces 104*c* and 104*d* support the positioning of the secondary transfer roller 100 relative to the supplementary rotation unit 64 in the rotation axis direction of the roller portion 102.

As in the present example embodiment, the guide pieces 104*c* and 104*d* are preferably disposed so as to be projected from the lower circular-arc portion of the roller attachment part 104*a* illustrated in FIG. 8B outward in a radial direction of the rotation axis of the roller portion 102.

On performing the above positioning, the operator first engages the respective edge portions 70*a* (illustrated in FIG. 8B), which form the open portions of the roller receiving part 70 in the supplementary rotation unit 64, into a space between the guide pieces 104*c* and 104*d*. Thereby, the secondary transfer roller 100 is positioned relative to the supplementary rotation unit 64 in the rotation axis direction thereof.

Then, the operator moves the secondary transfer roller 100 in a direction perpendicular to the rotation axis direction of the roller portion 102 so as to insert the roller attachment part 104*a* of the secondary transfer roller 100 into the open portion of the roller receiving part 70.

Thus, according to the present example embodiment, the position of the secondary transfer roller 100 relative to the supplementary rotation unit 64 in the rotation axis direction of the roller portion 102 is previously determined with the guide pieces 104*c* and 104*d*. Then, the operator can insert the roller attachment part 104*a* into the open portion of the roller receiving part 70 by moving the secondary transfer roller 100 in a direction perpendicular to the rotation axis direction of the roller portion 102.

Therefore, a relatively high operation efficiency may be obtained compared to a case where the operator inserts the roller attachment part 104*a* into the open portion of the roller receiving part 70 while performing positioning of the secondary transfer roller 100 in both of the rotation axis direction of the roller portion 102 and the direction perpendicular thereto.

As described above, in the present example embodiment, the guide pieces 104*c* and 104*d* are provided for each of the roller attachment parts 104*a* at an outer side and an inner side, respectively, thereof in the rotation axis direction of the roller portion 102. However, another configuration may be employed to obtain a similar effect to the present example embodiment.

Figure 10:
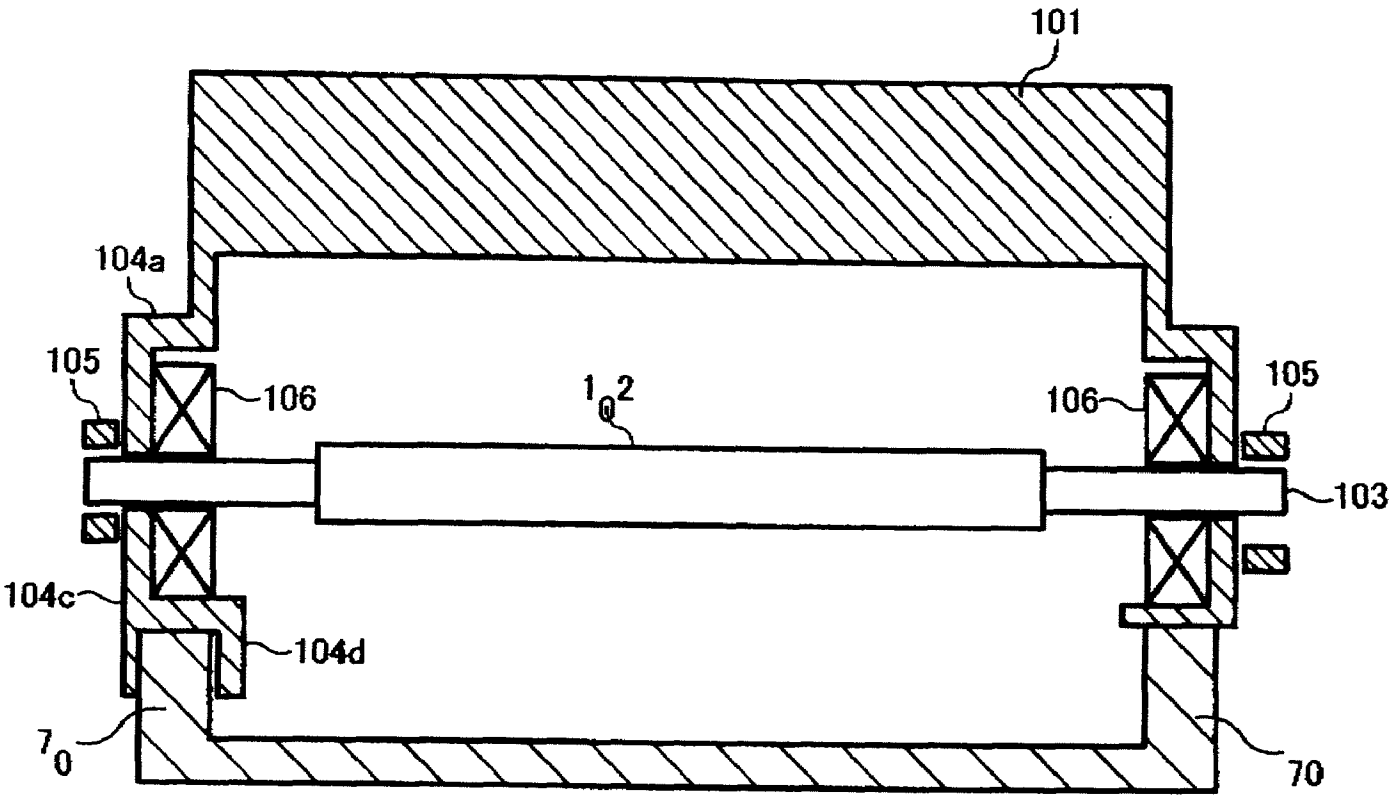
FIG. 10 is an explanatory diagram illustrating another embodiment of the guide pieces of FIG. 9 provided in the secondary transfer roller.

As another example embodiment, a configuration as illustrated in FIG. 10 may be employed. In FIG. 10, the guide pieces 104*c* and 104*d* are provided at an outer side and an inner side of any one of the roller attachment parts 104*a* in the rotation axis direction of the roller portion 102. Thereby, similar to the present example embodiment, operation efficiency may be increased in the replacement operation of the secondary transfer roller 100.

Figure 11:
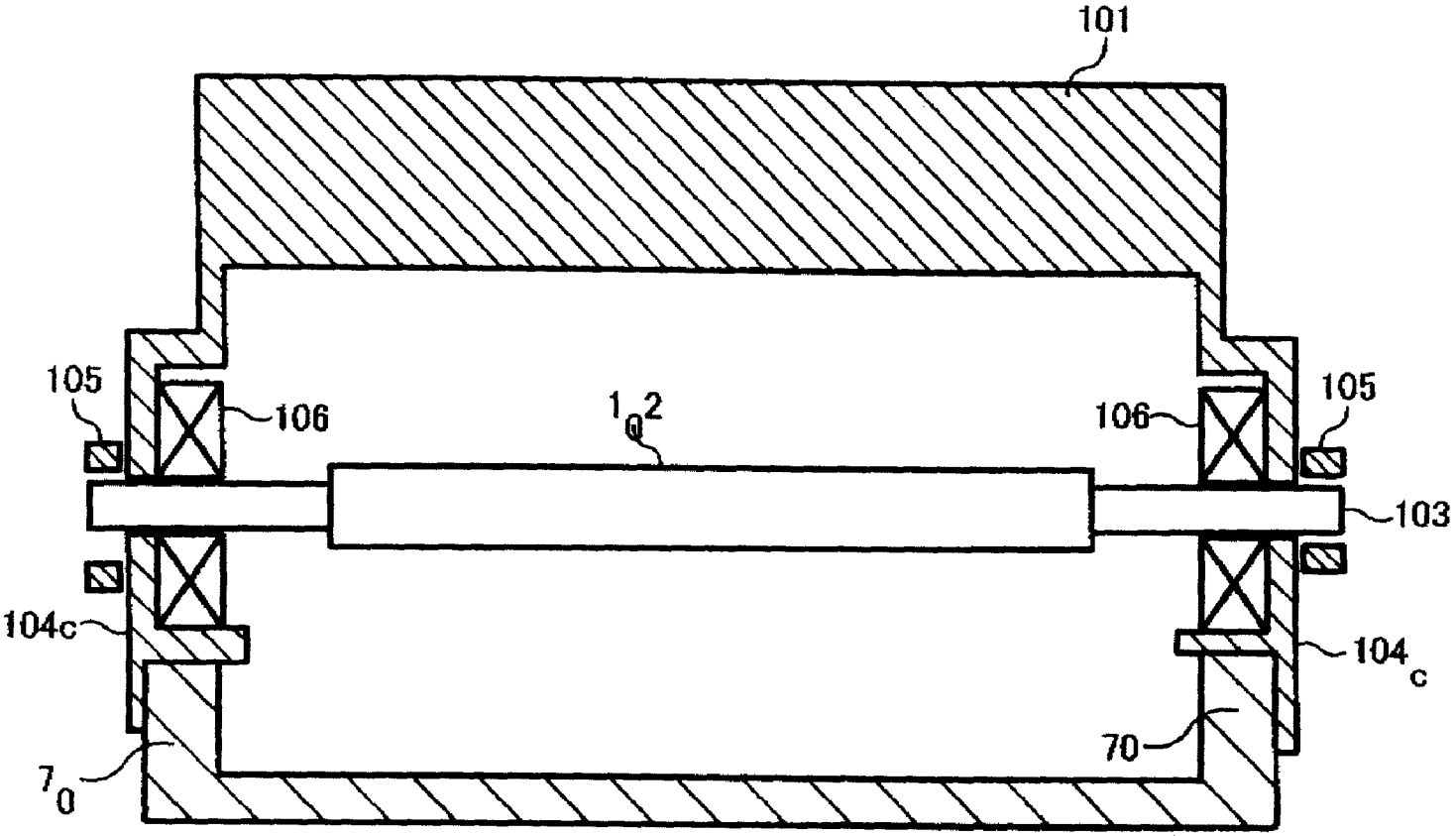
FIG. 11 is an explanatory diagram illustrating another embodiment of the guide pieces of FIG. 9 provided in the secondary transfer roller.

As another example embodiment, a configuration as illustrated in FIG. 11 may be employed. In FIG. 11, the guide pieces 104*c* are provided only at each outer side of the roller attachment parts 104*a* in the rotation axis direction of the roller portion 102. Thereby, similar to the present example embodiment, operation efficiency may be increased in the attachment operation of the secondary transfer roller 100.

Alternatively, although not illustrated, the guide 104*d* may be provided only at each inner side of the roller attachment parts 104*a* in the rotation axis direction of the roller portion 102.

Figure 12:
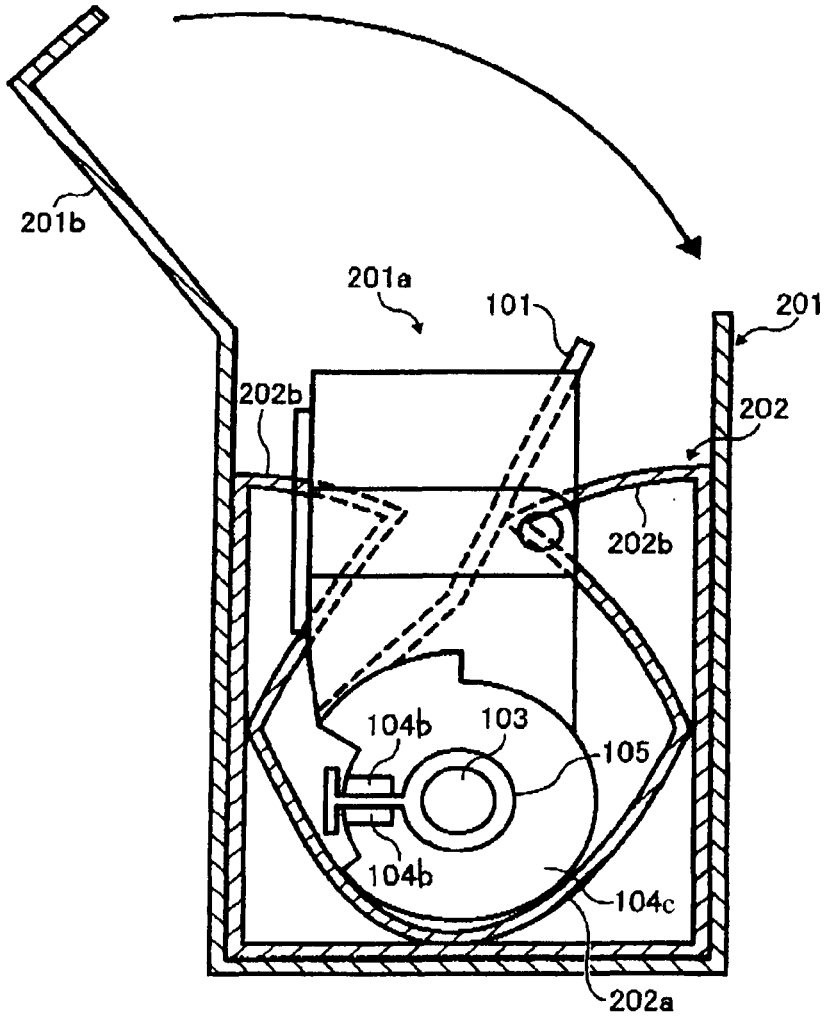
FIG. 12 is an explanatory diagram illustrating a cross section of a replacement package with the secondary transfer roller packaged therein, substantially perpendicular to the rotation axis direction of the roller portion.

Next, referring to FIG. 12, a replacement package with a secondary transfer roller 100 packaged therein is described.

FIG. 12 is an explanatory diagram illustrating a cross section of a replacement package with a secondary transfer roller 100 packaged therein, substantially perpendicular to the rotation axis direction of the roller portion 102.

A packaging member includes a housing box 201 and a holding member 202. The housing box 201 houses the replacement secondary transfer roller 100 therein, and is provided with an extraction mouth 201 a from which the secondary transfer roller 100 is taken out. The extraction mouth 201*a* is provided in a plane parallel to the rotation axis direction of the roller portion 102. The holding member 202 holds the housed secondary transfer roller 100 in an orientation so that upper portions of the transfer exit guide 101 and the gripper 104 thereof is directed to the extraction mouth 201*a* of the housing box 201.

The housing box 201 has a rectangular parallelepiped shape that extends longer in a direction parallel to the rotation axis direction of the roller portion 102. The housing box 201 includes a cover part 201*b* to cause the extraction mouth 201*a* to be opened and closed relative to the exterior of the housing box 201. According to the present example embodiment, the housing box 201 is made of corrugated cardboard, which is cut and is folded into a shape as illustrated in FIG. 12. The housing box 201 may also be made of publicly known materials for a housing box.

The holding member 202 includes a roller holding part 202*a* and a guide holding part 202*b*. The roller holding part 202*a* holds a lower portion of the roller portion 102 of the secondary transfer roller 100. The guide holding part 202*b* limits a movement of the transfer exit guide 101 so as to be directed substantially to the extraction mouth. According to the present example embodiment, the holding member 202 is made of corrugated cardboard, which is cut and is folded into a shape as illustrated in FIG. 12. The holding member 202 may, however, be made of publicly known materials for a housing box.

On taking out the secondary transfer roller 100 from the packaging member, the operator opens the cover part 201*b* so that the extraction mouth 201*a* is opened to the exterior of the housing box 201. At this time, according to the present example embodiment, the secondary transfer roller 100 is held with the guide holding part 202*b* of the holding member 202 in the orientation so that the transfer exit guide 101 and the gripper 104 are directed to the extraction mouth 201*a*, as described above. Accordingly, the operator can relatively easily take the secondary transfer roller 100 out of the housing box 201 by putting his or her hands through the extraction mouth 201*a* into the housing box 201, gripping and pulling up on the transfer exit guide 101 or the gripper 104.

In addition, according to the present example embodiment, while holding the transfer exit guide 101 or the gripper 104 after the extraction, the operator can attach the secondary transfer roller 100 to the supplementary roller unit 64. Therefore, from the extraction of the secondary transfer roller 100 out of the housing box 201, to the attachment thereof to the supplementary roller unit 64, the operator does not need to regrip the secondary transfer roller 100. Thus, a relatively high operation efficiency may be obtained.

As described above, the image forming apparatus 100 according to the present example embodiment includes the secondary transfer roller 100 and the sandwiching members 19*a* and 19*b*. The secondary transfer roller 100 serves as a roller member attachable to and detachable from the image forming apparatus 100. The sandwiching members 19*a* and 19*b* serve as a roller support member to support the shaft end portion 103 of the secondary transfer roller 100 via the cap 105 serving as the roller receiving member.

The secondary transfer roller 100 also includes the roller portion 102, and the two shaft end portions 102 extended from both ends of the roller portion 102 outward in the rotation axis direction of the roller portion 102. Further, the secondary transfer roller 100 includes the transfer exit guide 101 and the gripper 104 serving as a gripping member that is rotatably provided around the two shaft end portions 103.

Accordingly, when performing a replacement operation of the secondary transfer roller 100, an operator can handle the secondary transfer roller 100 while gripping the gripper 104 or the transfer exit guide 101. Thus, attachment of dirt from the operator's hand to a surface of the roller portion 102 can be reduced, resulting in less deterioration in sheet conveyance performance of the secondary transfer roller 100 or degradation in image quality due to unevenness in an electric field of the secondary transfer area. Further, a decrease in operation efficiency may be reduced in snapping the roller attachment part 104*a* of the gripper 104 into the roller receiving part of the supplementary roller unit 64.

Furthermore, according to the present example embodiment, the grippers 104 and the transfer exit guide 101 may be a single member rotatably provided around the two shaft end portions 103. If gripping members are separately provided around each of the two shaft end portions 103, rotated positions of the gripping members may be different from each other, causing delay in the operator's handling thereof. Compared to this, according to the present example embodiment, such a difference between rotated positions of the gripping members does not occur, resulting in efficient handling of the secondary transfer roller 100.

Moreover, according to the present example embodiment, the roller member subjected to the replacement operation is configured to be used as the secondary transfer roller 100 serving as a conveyance roller to convey a sheet by contacting one surface of the sheet when the secondary transfer roller 100 is attached to the image forming apparatus 200.

The transfer exit guide 101 is used as the gripping member. The transfer exit guide 101 also serves as a conveyance regulation member to regulate a conveyance direction of the sheet by contacting the sheet during conveyance when the secondary transfer roller 100 is attached to the apparatus body 50.

Conventionally, from a viewpoint of downsizing the apparatus, since the gripping member is not related to the image forming operation of the image forming apparatus 200, the size of the gripping member of the secondary transfer roller 100 is preferably smaller. However, a smaller size of the gripping member may reduce operability of the secondary transfer roller 100 in the replacement operation thereof.

Then, according to the present example embodiment, the transfer exit guide 101 having a relatively large size corresponding to a sheet size is used as the gripping member of the secondary, transfer roller 100 that is gripped when the secondary transfer roller 100 is attached to the image forming apparatus 200. Thereby, the downsizing of the image forming apparatus 200 and the operability of the secondary transfer roller 100 can go together.

Incidentally, in the above description of the present example embodiment, the secondary transfer roller 100 is explained as a roller member subjected to the replacement operation. However, the roller member subjected to the replacement operation may be another roller member, and may be a drive roller or a driven roller.

In addition, according to the present example embodiment, the transfer exit guide 101 may be made of ABS resin, resulting in a less fragile property and a relatively high operability in handling the transfer exit guide 101.

Incidentally, as explained in the above description of the present example embodiment, the transfer exit guide 101 is preferably made of a resin that does not contain any butadiene component.

In the secondary transfer roller 100 according to the present example embodiment, the cap 105 is attached to at least one of the two shaft end portions 103. The cap 105 serves as the cap-shaped shaft bearing member that may slidably move along an outer circumferential surface of the two shaft end portions 103. The cap 105 is fixed with the sandwiching members 19*a* and 19*b* of the apparatus body 50 when the secondary transfer roller 100 is attached to the apparatus body 50.

The secondary transfer roller 100 also includes the sandwiching members 104*b* and the connecting member 105*c* to fix the cap 105 to the roller attachment part 104*a* of the gripper 104. The configuration as described above can suppress unintentional detachment of the cap 105 from the shaft end portion 103.

Further, according to the present example embodiment, the cap 105 may be a resin member having an inner circumferential surface that is slidably moved around the shaft end portion 103 with a relatively low frictional force. Therefore, a cap capable of being smoothly rotated around the shaft end portion 103 may be produced at a relatively lower cost.

The above fixing members according to the present example embodiment include the connecting member 105*c* and the sandwiching members 104*b*. The connecting member 105*c* serving as an engaging part is projected from the outer circumferential surface of the cap 105 to a radial direction thereof.

The sandwiching members 104*b*, serving as an engaged part, is disposed in an outer side of each of the roller attachment parts 104*a* of the grippers 104 in the rotation axis direction of the roller portion 102. The connection member 105*c* may be configured to be sandwiched with the sandwiching members 104*b* when the connecting member 105*c* is engaged into the sandwiching members 104*b* from an outer side thereof in the rotation axis direction of the roller portion 102.

With the configuration as described above, an operator can attach the cap 105 to the shaft end portion 103 through a simple operation of engaging the connecting member 105*c* of the cap 105 into the sandwiching members 104*b* from the external side in the rotation axis direction of the roller portion 102. Further, the manufacturing process of the secondary transfer roller 100 may be simplified, resulting in an increase in productivity thereof.

Incidentally, a similar effect may be obtained with a configuration in which sandwiching members serving as an engaged part are disposed in the cap 105, and an engaging part to be sandwiched with the sandwiching members is disposed in the roller attachment part 104*a*.

Figure 13:
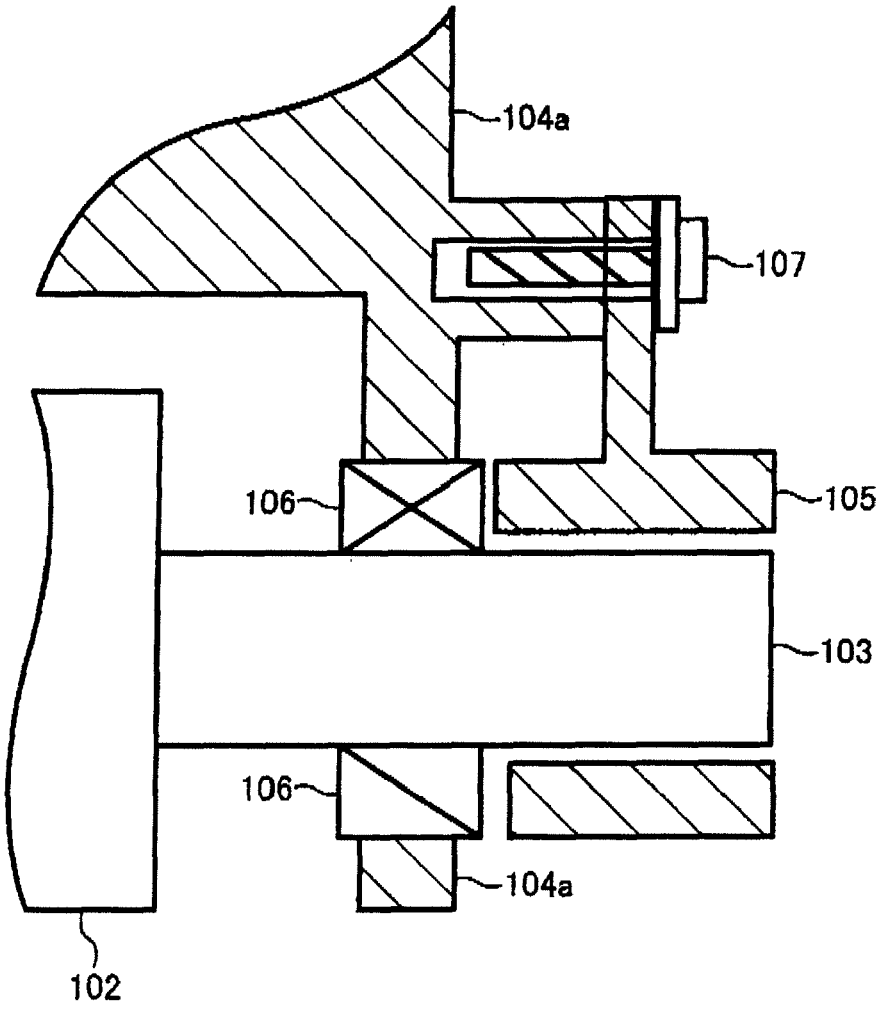
FIG. 13 is an explanatory diagram illustrating a cross section of another embodiment of the fixing member of FIG. 5, parallel to the rotation axis direction of the roller portion.

The above fixing member may be configured to be a screw member 107 as illustrated in FIG. 13. The screw member 107 screws the cap 105 onto the roller attachment part 104*a* of the gripper 104, thereby further suppressing unintentional detachment of the cap 105 from the shaft end portion 103.

According to the present example embodiment, the cap 105 includes the marked member 105*b* indicating an attachment direction in which the secondary transfer roller 100 is attached to the apparatus body 50. Thus, mistakes regarding the attachment direction may be reduced, and operation efficiency in the replacement operation may be increased.

In addition, according to the present example embodiment, the apparatus body 50 has another marked member which corresponds to the marked member 105*b* disposed at the cap 105 when the secondary transfer roller 100 is attached to the apparatus body 50. Therefore, the marked member 105*b* of the cap 105 may also indicate an attachment position at which the secondary transfer roller 100 is attached to the apparatus body 50. With the marked member 105*b*, mistakes of the attachment position may be reduced, and operation efficiency in the replacement operation may be increased.

Figure 14:
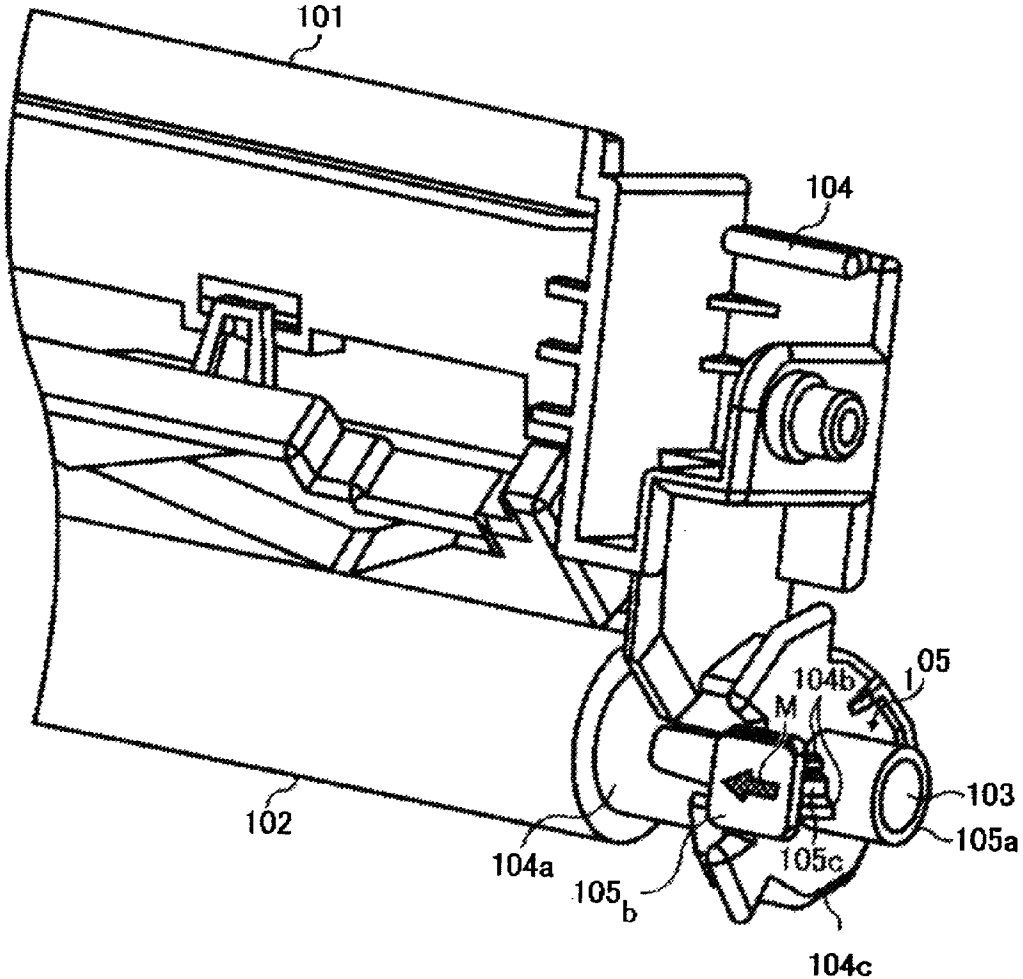
FIG. 14 is an explanatory diagram illustrating another embodiment of the marked member of FIG. 5 disposed on the cap member.

For the marked member 105*b* indicating the attachment position of the secondary transfer roller 100, as illustrated in FIG. 14, an arrow M directed to an inner side in the rotation axis direction of the roller portion 102 may be employed as a mark formed on the marked member 105*b*. Thereby, mistakes of the attachment position may be effectively reduced, and operation efficiency in the replacement operation may be further increased.

In the above description of the present example embodiment, the secondary transfer roller is supported with the apparatus body 50 in a manner such that the rotatable cap 105, which is slidably moved around the shaft end portion 103, is sandwiched with the sandwiching members 19*a* and 19*b* disposed in the apparatus body 50. However, the secondary transfer roller may be supported with the apparatus body 50 in another manner.

Figure 15:
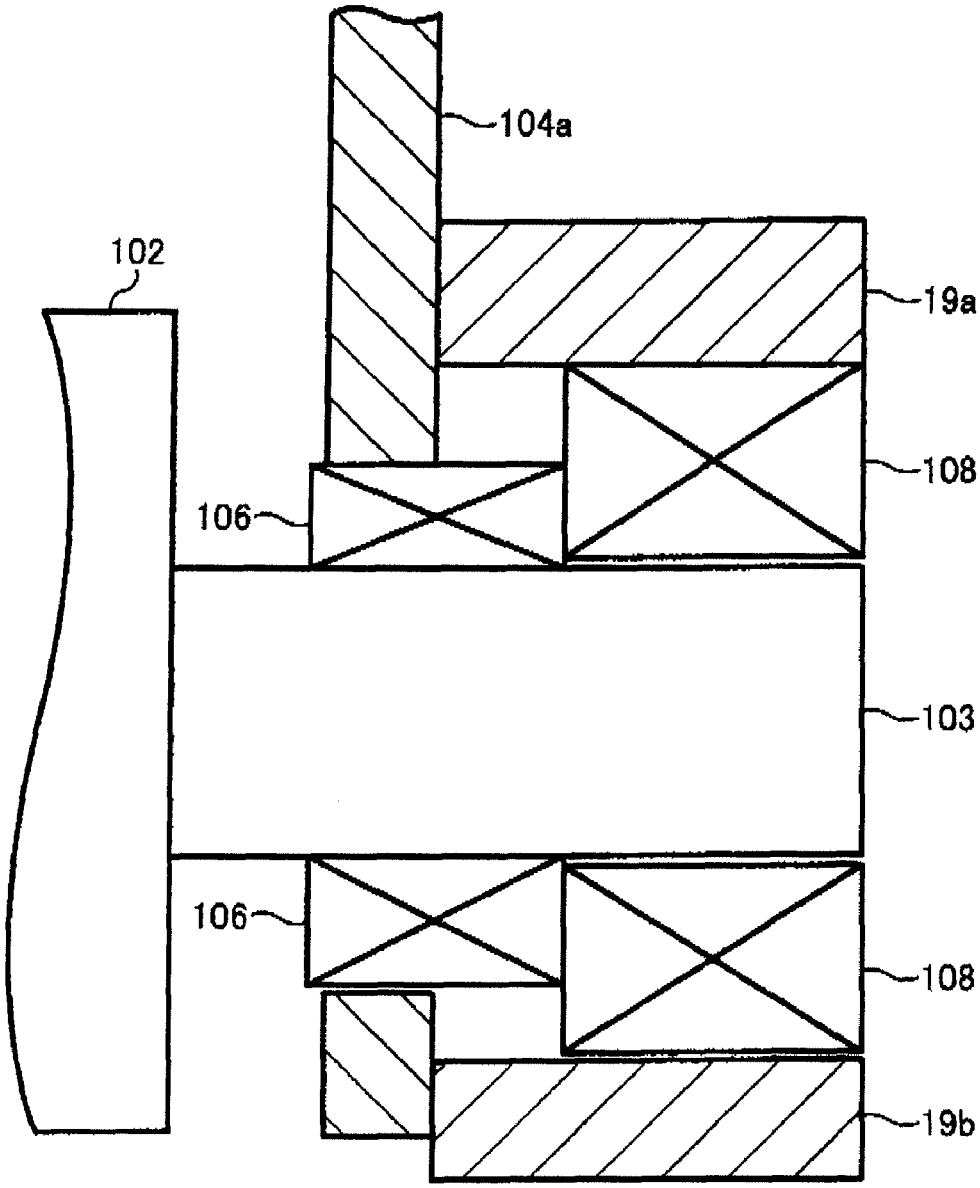
FIG. 15 is an explanatory diagram illustrating a shaft bearing member including a ball bearing that is employed instead of the cap member of FIG. 5.

For example, a shaft bearing member 108 including a ball bearing as illustrated in FIG. 15 may be employed instead of the cap 105. The inner circumferential surface of the shaft bearing member 108 is fixed to at least one of the shaft end portions 103. On the other hand, the outer circumferential surface of the shaft bearing member 108 is fixed with the sandwiching members 19*a* and 19*b* of the apparatus body 50 when the secondary transfer roller 100 is attached to the apparatus body 50.

In this case, a load applied between the shaft end portion 103 and the sandwiching members 19*a* and 19*b* during rotation may be reduced. Therefore, a relatively smooth rotation of the shaft end portion 103 may be obtained while the secondary transfer roller 100 is attached to the apparatus body 50.

Further, in another example embodiment illustrated in FIG. 15, the shaft bearing member 108 is attached to the shaft end portion 103 by press-fit fixation. Therefore, operation efficiency may be increased in attaching the shaft bearing member 108 to the shaft end portion 103. As a result, the productivity of the secondary transfer roller 100 may be increased.

Figure 16:
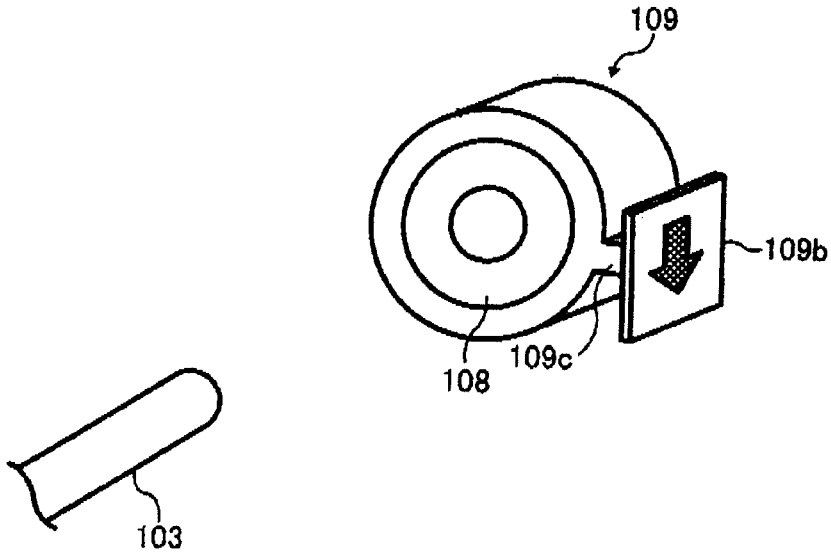
FIG. 16 is an explanatory diagram illustrating another embodiment of the shaft bearing member of FIG. 15.

In addition, as illustrated in FIG. 16, a collar member 109 may be provided so as to be attached onto an outer surface of the shaft bearing member 108 from an outer side thereof in the rotation axis direction of the roller portion 102. The collar member 109 has a cylindrical shape and an opening formed on one end face of the front side thereof in FIG. 16. Further, a fixing member may be provided to fix the cylindrical collar member 109 to the roller attachment part 104*a* of the gripper 104.

The collar member 109 also has a similar configuration to the cap 105 of the present example embodiment except for a difference in diameter. Accordingly, similar to the present example embodiment, the fixing member of the collar member 109 also includes a connecting member 109*c* and sandwiching members 104*b*. The connecting member 109*c* is projected from an outer circumferential surface of the collar member 109 outward in a radial direction thereof, and serves as an engaging part. The sandwiching members 104*b* are disposed on an outer side of the roller attachment part 104*a* of the gripper 104 in the rotation axis direction of the roller portion 102, and serves as an engaged part. The connecting member 109*c* may be configured to be sandwiched with the sandwiching members 104*b* when the connecting member 109*c* is put into the sandwiching members 104*b* from an outer side thereof in the rotation axis direction of the roller portion 102.

When the configuration as illustrated in FIG. 16 is employed, the shaft bearing member 108 is first attached into the collar member 109, and then the shaft end portion 103 is inserted into an inner circumferential space of the shaft bearing member 108. Further, the connecting member 109*b* of the collar member 109 is engaged into the sandwiching members 104*b* of the roller attachment part 104*a*.

Thus, the shaft bearing member 108 can be attached to the shaft end portion 103. The above attachment operation may be relatively simply accomplished, compared to the attachment operation in which the shaft bearing member 108 is attached to the shaft end portion 103 by press-fit fixation. Therefore, the productivity of the secondary transfer roller 100 may be further increased.

Incidentally, similar to the example embodiment illustrated in FIG. 13, when the fixing member is configured to be a screw member to screw the collar member 109 onto the roller attachment part 104*a* of the gripper 104, unintentional detachment of the collar member 109 from the secondary transfer roller 100 may be suppressed.

According to the present example embodiment, the packaging member of the replacement for the secondary transfer roller 100 includes the housing box 201 and the holding member 202. In the housing box 201, the extraction mouth 201*a* is formed so that the replacement secondary transfer roller 100 can be extracted therefrom. The holding member 202 holds the replacement secondary transfer roller 100 that is housed in the housing box 201 in an orientation so that the gripper 104 or the transfer exit guide 101 of the replacement secondary transfer roller 100 is directed to the extraction mouth 201*a*.

Accordingly, in the replacement operation of the secondary transfer roller 100, an operator can extract the replacement secondary transfer roller 100 from the housing box 201 while griping the gripper 104 or the transfer exit guide 101 thereof. As a result, opportunities may be reduced in which dirt from the operator's hand is attached to a surface of the roller portion 102, thereby suppressing deterioration in sheet conveyance performance of the secondary transfer roller 100 or degradation in image quality due to unevenness in an electric field of the secondary transfer area. Further, a decrease in operation efficiency may be reduced when the roller attachment part 104*a* of the gripper 104 attached to the shaft end portion 103 is engaged into the roller receiving part 70 of the supplementary roller unit 64.

In the image forming apparatus 200 according to the present example embodiment, the apparatus body 50 is provided with the roller receiving part 70 serving as the gripper holding member to hold the gripper 104 or the transfer exit guide 101 of the secondary transfer roller 100. The gripper 104 of the secondary transfer roller 100 includes the roller attachment part 104*a* serving as the held part that is held by the roller receiving part 70.

The roller attachment part 104*a* has a shape as illustrated in FIG. 8B, having different lengths R' and r' from each other in two directions perpendicular to a plane including the rotation axis direction of the roller portion 102.

The roller receiving part 70 includes an open portion serving as a receiving mouth for the roller attachment part 104*a*. The open portion has a dimension corresponding to a minimum length r' in a direction perpendicular to a roller axis direction of the roller attachment part 104*a*.

Only when the roller attachment part 104*a* is oriented relative to the open portion of the roller receiving part 70 as illustrated in FIG. 8B, can the roller attachment part 104*a* be engaged into the roller receiving part 70, and the secondary transfer roller 100 be attached to the supplementary rotation unit 64. Regulating the attachment direction as above may effectively suppress improper attachment of the secondary transfer roller 100 to the supplementary rotation unit 64.

According to the present example embodiment, the roller attachment part 104*a* may be configured as an attachment part of the gripper 104 used when the gripper 104 is attached to each of the shaft end portions 103 disposed at an outer side of the roller portion 102 in the rotation axis direction of the roller portion 102.

The guide pieces 104*c* and 104*d* are disposed at an outer adjacent area and at an inner adjacent area of the roller attachment part 104*a* in the rotation axis direction of the roller portion 102. The guide pieces 104*c* and 104*d* contact an outer side and an inner side of the edge portions 70*a*, forming the open portion in the roller axis direction of the roller portion 102. Thereby, the guide pieces 104*c* and 104*d* guide insertion of the roller attachment part 104*a* into the open portion of the roller receiving part 70.

Thus, with the guide pieces 104*c* and 104*d*, the position of the secondary transfer roller 100 is previously determined relative to the supplementary rotation unit 64 in the rotation axis direction of the roller portion 102. Under this condition, the positioning of the secondary transfer roller 100 is performed with respect to a direction perpendicular to the rotation axis direction of the roller portion 102.

Then, the roller attachment part 104*a* can be inserted into the open portion of the roller receiving part 70. Therefore, according to the present example embodiment, a relatively higher operation efficiency may be obtained compared to the case where the roller attachment part 104*a* is inserted into the open portion of the roller receiving part 70 while the positioning of the secondary transfer roller 100 is simultaneously performed in both the rotation axis direction of the roller portion 102 and a direction perpendicular thereto.

The image forming apparatus 200 according to the present example embodiment includes the duplexing unit 60 and the link mechanism. The duplexing unit 60 is disposed on the side surface of the apparatus body 50, and also serves as an openable and closable door relative to the upper area of the apparatus body 50. The link mechanism serves as a door holding member to hold the duplexing unit 60 in an opened position.

The roller receiving part 70 is disposed on an inner surface of the duplexing unit 60, facing the apparatus body 50. The roller receiving part 70 is also disposed so that the open portion of the roller receiving part 70 is oriented substantially vertically upward when the duplexing unit 60 is opened via the link mechanism.

Generally, the metal core is the heaviest portion in the secondary transfer roller 100. Accordingly, when the gripper 104 or the transfer exit guide 101 is gripped, the secondary transfer roller 100 is preferably held in such an orientation that the roller portion 102 is placed at the lowest position thereof. Thereby, the secondary transfer roller 100 can be handled with a relatively low effort. Thus, in the image forming apparatus 200 according to the present example embodiment, the secondary transfer roller 100 can be attached to the supplementary rotation unit 64 with a relatively low effort.

Numerous additional modifications and variations are possible in light of the above teachings. It is therefore to be understood that within the scope of the appended claims, the disclosure of this patent specification may be practiced otherwise than as specifically described herein.

What is claimed is:

1. A roller device that can be exchangeably used in an image forming apparatus, comprising:

a shaft, configured to have a rotation axis at a center thereof, including two shaft end portions;

a roller, configured to cover the shaft along the rotation axis, including two roller ends from which the two shaft end portions are projected outwardly along the rotation axis;

two grip members each rotatably disposed to a respective shaft end portion of the two shaft end portions via a roller attachment part;

a plate member integrally formed with the two grip members to rotatably move the two grip members in conjunction with each other;

two bearing members each attached to a corresponding one of the two shaft end portions at a position outside of the roller attachment part; and two fixing members each configured to fix one of the bearing members to a corresponding one of the two grip members, wherein each of the fixing members include an engaging portion disposed to an outer surface of one of the bearing members, and an engaged portion disposed to an outer surface of the corresponding one of the two grip members along the rotation axis and configured to be disposed to the engaging portion so as to fix the bearing member to the corresponding one of the two grip members when the bearing member is installed to one of the two shaft end portions.

2. The roller device of claim 1, wherein each of the two grip members includes an acrylonitrile butadiene styrene resin.

3. The roller device of claim 1, wherein each of the two grip members includes any resin, except for a resin including butadiene.

4. The roller device of claim 1, wherein each of the bearing members include an inner surface rotatably attached to one of the two shaft end portions, and the bearing members include a resin.

5. The roller device of claim 1, wherein the outer surface of each of the bearing members is supported by a supporter of the image forming apparatus when the roller device is attached to the image forming apparatus.

6. The roller device of claim 1, further comprising:

a ball bearing member including an inner surface attached to one of the two shaft end portions and an outer surface supported by a supporter of the image forming apparatus when the roller device is attached to the image forming apparatus.

7. The roller device of claim 6, wherein the ball bearing member is fixed to the one of the two shaft end portions by press-fit fixation.

8. The roller device of claim 1, further comprising:

a ball bearing member including an inner surface and an outer surface, wherein the inner surface is attached to one of the two shaft end portions; and a collar member including an inner surface and an outer surface and configured to be disposed to the ball bearing such that the inner surface of the collar member contacts the outer surface of the ball bearing member, wherein the engaging portion of one of the two fixing members is disposed to the outer surface of the collar member, and the engaged portion of the one of the two fixing members is configured to be disposed to the engaging portion so as to fix the collar member to the corresponding one of the two grip members when the collar member is installed to one of the two shaft end portions.

9. The roller device of claim 1, wherein the engaging portion is sandwiched by the engaged portion to fix the bearing member to the corresponding one of the two grip members.

10. The roller device of claim 1, wherein each of the grip members comprises a plate portion and a stepwise portion between the plate portion and the plate member.

11. The roller device of claim 1, wherein each of the grip members comprises a plate portion having a protruding portion that protrudes from an end portion of the plate portion in a direction in which the roller rotates.

12. A roller device that can be exchangeably used in an image forming apparatus, comprising:

a shaft, configured to have a rotation axis at a center thereof, including two shaft end portions;

a roller, configured to cover the shaft along the rotation axis, including two roller ends from which the two shaft end portions are projected outwardly along the rotation axis;

two grip members each rotatably disposed to a respective shaft end portion of the two shaft end portions via a roller attachment part;

a bearing member rotatably attached to one of the two shaft end portions at a position outside of the roller attachment part; and a fixing member configured to fix the bearing member to a corresponding one of the two grip members, wherein the fixing member includes an engaging portion disposed to an outer surface of the bearing member, and an engaged portion disposed to an outer surface of the corresponding one of the two grip members along the rotation axis and configured to be disposed to the engaging portion so as to fix the bearing member to the corresponding one of the two grip members when the bearing member is installed to one of the two shaft end portions, wherein the bearing member includes an indicator configured to indicate at least one of an installation direction in which the roller device is installed to the image forming apparatus and an installation position at which the roller device is installed to the image forming apparatus.

13. The roller device of claim 9 (12), wherein the installation direction indicates an inward direction along the rotation axis.

14. A roller replacement package, comprising:

a roller device exchangeably used in an image forming apparatus, the roller device including a shaft, configured to have a rotation axis at a center thereof, including two shaft end portions, a roller, configured to cover the shaft along the rotation axis, including two roller ends from which the two shaft end portions of the shaft are projected outwardly along the rotation axis, two grip members each rotatably disposed to a respective shaft end portion of the two shaft end portions via a roller attachment part, a plate member integrally formed with the two grip members to rotatably move the two grip members in conjunction with each other, two bearing members each attached to a corresponding one of the two shaft end portions at a position outside of the roller attachment part, and two fixing members each configured to fix one of the bearing members to a corresponding one of the two grip members, wherein each of the fixing members include an engaging portion disposed to an outer surface of one of the bearing members, and an engaged portion disposed to an outer surface of the corresponding one of the two grip members along the rotation axis and configured to be disposed to the engaging portion so as to fix the bearing member to the corresponding one of the two grip members when the bearing member is installed to one of the two shaft end portions;

a housing member configured to house the roller device, wherein the housing member has an outlet through which the roller device is installed and removed, and the outlet is formed such that the roller device is installed and removed in a direction perpendicular to the rotation axis; and a supporter disposed inside the housing member and configured to support the roller device such that the two grip members of the roller device are positioned towards the outlet of the housing member.

15. The roller replacement package of claim 14, wherein at least one of the bearing members include an arrow positioned to indicate at least one of an installation direction in which the roller device is installed to the image forming apparatus and an installation position at which the roller device is installed to the image forming apparatus.

16. An image forming apparatus, comprising:

a roller device configured to be exchangeably used in the image forming apparatus, the roller device including a shaft, configured to have a rotation axis at a center thereof, including two shaft end portions, a roller, configured to cover the shaft along the rotation axis, including two roller ends from which the two shaft end portions are projected outwardly along the rotation axis, two grip members each rotatably disposed to a respective shaft end portion of the two shaft end portions via a roller attachment part, a plate member integrally formed with the two grip members to rotatably move the two grip members in conjunction with each other, a bearing member attached to one of the two shaft end portions at a position outside of the roller attachment part, and a fixing member configured to fix the bearing member to a corresponding one of the two grip members, wherein the fixing members includes an engaging portion disposed to an outer surface of the bearing member, and an engaged portion disposed to an outer surface of the corresponding one of the two grip members along the rotation axis and configured to be disposed to the engaging portion so as to fix the bearing member to the corresponding one of the two grip members when the bearing member is installed to one of the two shaft end portions; and a supporter configured to support the shaft by holding the one of the two shaft end portions through the bearing member.

17. The image forming apparatus of claim 16, further comprising:

grip holders configured to hold the two grip members, wherein each of the two grip members includes a cylindrical portion configured to be held by a corresponding one of the grip holders and including two different diameters in perpendicular directions at a position along the rotation axis of the shaft, and each of the grip holders has a substantially circular opening configured to fit with a larger diameter of the two different diameters for rotation and an entry opening, in communication with the circular opening, configured to fit with a smaller diameter of the two different diameters for entry of the grip members.

18. The image forming apparatus of claim 17, further comprising:

a guide configured to guide the roller device at an installation, wherein each of the two grip members includes the roller attachment part to be attached to a corresponding one of the two shaft end portions, and the cylindrical portion of each of the two grip members is a part of the roller attachment part of a corresponding one of the two grip members, and the guide is disposed next to the attachment portion of one of the two grip members and disposed to a corresponding one of the two grip holders at the entry opening when the roller device is installed in the image forming apparatus.

19. The image forming apparatus of claim 17, further comprising:

a door vertically disposed and configured to be swingably openable about a bottom side thereof; and a door holder configured to hold the door tilted at a given upward open angle, wherein each of the grip holders are disposed such that the entry opening of the grip holder faces upward substantially along a vertical line.

20. The image forming apparatus of claim 17, further comprising:

a first indicator indicating an installation position, wherein the roller device includes a second indicator indicating at least one of an installation direction in which the roller device is installed to the image forming apparatus and the installation position at which the roller device is installed to the image forming apparatus, and the first indicator and the second indicator are disposed next to each other when the roller device is installed in the image forming apparatus.

21. The image forming apparatus of claim 16, wherein the bearing member includes an arrow positioned to indicate at least one of an installation direction in which the roller device is installed to the image forming apparatus and an installation position at which the roller device is installed to the image forming apparatus.

22. An image forming apparatus comprising a roller device exchangeably provided in the image forming apparatus, the roller device comprising:

a shaft, configured to have a rotation axis at a center thereof, including two shaft end portions;

a roller, configured to cover the shaft along the rotation axis, including two roller ends from which the two shaft end portions are projected outwardly along the rotation axis;

two roller attachment parts each attached to a corresponding one of the shaft end portions of the shaft;

a plate member provided rotatably with the two roller attachment parts;

at least one slide bearing member attached to at least one of the two shaft end portions at a position outside of at least one of the roller attachment parts;

an engaging portion provided on an outer surface of the at least one slide bearing member, and a pair of engaged portions disposed on the at least one of the roller attachment parts along the rotation axis of the shaft to engage the engaging portion when the at least one slide bearing member is installed to the at least one of the two shaft end portions along the rotation axis of the shaft, wherein the at least one slide bearing member has a cylindrical shape including an inner hollow into which the at least one of the two shaft end portions is inserted, and by fitting the inner hollow of the at least one slide bearing member from an outside of the shaft to the at least one of the two shaft end portions along the rotation axis, the engaging portion is inserted from the outside of the shaft to a space between the pair of engaged portions along the rotation axis and the pair of engaged portions prevents rotation of the at least one slide bearing member relative to the at least one of the two roller attachment parts.

23. The image forming apparatus according to claim 22, wherein the engaging portion is a sandwiched member protruding from the outer surface of the at least one slide bearing member, and the pair of engaged portions is a sandwiching member to sandwich the sandwiched member from both sides of the sandwiched member in a rotation direction of the roller.

24. The image forming apparatus according to claim 23, wherein, when the at least one slide bearing member is installed to the at least one of the two shaft end portions along the rotation axis of the shaft, the sandwiching member sandwiches the sandwiched member to fix the at least one slide bearing member to the at least one of the roller attachment parts in a snap-fit manner.

25. The image forming apparatus according to claim 22, wherein the roller attachment parts are integrally formed with the plate member.

26. The image forming apparatus according to claim 22, wherein the roller attachment parts are formed separately from the plate member.

27. The image forming apparatus according to claim 22, wherein the at least one slide bearing member is formed with a resin of a relatively low friction coefficient against an outer circumferential surface of the shaft.

28. The image forming apparatus according to claim 22, further comprising at least one grip member at a position outside of the plate member along the rotation axis of the shaft.

29. The image forming apparatus according to claim 22, wherein the at least one slide bearing member is two slide bearing members, and each of the two slide bearing members is slidably attached to a corresponding one of the two shaft end portions at a position outside the roller attachment parts, and wherein the engaging portion is provided on the outer surface of each of the two slide bearing members, the pair of engaged portions is disposed on each of the two roller attachment parts in parallel along the rotation axis of the shaft and, when each of the two slide bearing members is installed to the corresponding one of the two shaft end portions along the rotation axis of the shaft, the pair of engaged portions on each of the two roller attachment parts engages the engaging portion on the outer surface of each of the two slide bearing members.

30. The image forming apparatus according to claim 22, wherein the pair of engaged portions is provided on an outer surface of the at least one of the roller attachment parts.

31. The image forming apparatus according to claim 22, wherein the roller attachment parts are attached to the shaft via ball bearings.

32. The image forming apparatus according to claim 22, further comprising a supplementary unit pivotable relative to the image forming apparatus, wherein the roller device is detachably mounted in the supplementary unit.

33. The image forming apparatus according to claim 32, further comprising a positioning unit to position the at least one slide bearing member of the roller device in a sandwiching manner when the roller device is installed in the image forming apparatus.

34. An image forming apparatus comprising a roller device exchangeably provided in the image forming apparatus, the roller device comprising:

a shaft, configured to have a rotation axis at a center thereof, including two shaft end portions;

a roller, configured to cover the shaft along the rotation axis, including two roller ends from which the two shaft end portions are projected outwardly along the rotation axis;

roller attachment parts attached to the two shaft end portions of the shaft;

a conveyance guide member provided rotatably with the roller attachment parts to guide a recording medium conveyed in the image forming apparatus;

at least one slide bearing member attached on at least one of the two shaft end portions at a position outside of at least one of the roller attachment parts;

an engaging portion provided on an outer surface of the at least one slide bearing member; and a pair of engaged portions disposed on the at least one of the roller attachment parts along the rotation axis to engage the engaging portion when the at least one slide bearing member is installed to the at least one of the two shaft end portions along the rotation axis of the shaft, wherein the at least one slide bearing member has a cylindrical shape including an inner hollow into which the at least one of the two shaft end portions is inserted, and by fitting the inner hollow of the at least one slide bearing member from an outside of the shaft to the at least one of the two shaft end portions along the rotation axis, the engaging portion is inserted from the outside of the shaft to a space between the pair of engaged portions along the rotation axis and the pair of engaged portions prevents rotation of the at least one slide bearing member relative to the at least one of the roller attachment parts.

35. An image forming apparatus comprising a roller device exchangeably provided in the image forming apparatus, the roller device comprising:

a shaft, configured to have a rotation axis at a center thereof, including two shaft end portions;

a roller, configured to cover the shaft along the rotation axis, including two roller ends from which the two shaft end portions are projected outwardly along the rotation axis;

roller attachment parts attached to the two shaft end portions of the shaft;

a conveyance guide member provided rotatably with the roller attachment parts to guide a recording medium conveyed in the image forming apparatus;

at least one slide bearing member attached on at least one of the two shaft end portions;

an engaging portion provided on an outer surface of the at least one slide bearing member; and a pair of engaged portions disposed on at least one of the roller attachment parts along the rotation axis to engage the engaging portion when the at least one slide bearing member is installed to the at least one of the two shaft end portions along the rotation axis of the shaft, wherein the at least one slide bearing member has a cylindrical shape including an inner hollow into which the at least one of the two shaft end portions is inserted, and by fitting the inner hollow of the at least one slide bearing member from an outside of the shaft to the at least one of the two shaft end portions along the rotation axis, the engaging portion is inserted from the outside of the shaft to a space between the pair of engaged portions along the rotation axis and the pair of engaged portions prevents rotation of the at least one slide bearing member relative to the at least one of the roller attachment parts.

36. The image forming apparatus according to claim 35, wherein the at least one slide bearing member is installed on the at least one of the two shaft end positions from outside of the at least one of the roller attachment parts along the rotation axis.

37. The image forming apparatus according to claim 35, wherein the engaging portion is a sandwiched member protruding from the outer surface of the at least one slide bearing member, and the pair of engaged portions is a sandwiching member to sandwich the sandwiched member from both sides of the sandwiched member in a rotation direction of the roller.

38. The image forming apparatus according to claim 35, wherein the at least one slide bearing member is formed with a resin of a relatively low friction coefficient against an outer circumferential surface of the shaft.

39. The image forming apparatus according to claim 35, wherein the engaging portion being fit into the space between the pair of engaged parts prevents rotation of the engaging portion relative to the at least one of the roller attachment parts.

40. An image forming apparatus comprising a roller device exchangeably provided in the image forming apparatus, the roller device comprising:

a shaft, configured to have a rotation axis at a center thereof, including two shaft end portions;

a roller, configured to cover the shaft along the rotation axis, including two roller ends from which the two shaft end portions are projected outwardly along the rotation axis;

roller attachment parts attached to the two shaft end portions of the shaft;

a conveyance guide member provided rotatably with the roller attachment parts to guide a recording medium conveyed in the image forming apparatus;

at least one slide bearing member attached on at least one of the two shaft end portions;

a projecting portion projecting from an outer surface of the at least one slide bearing member; and a pair of preventing portions disposed on at least one of the roller attachment parts along the rotation axis to engage the projecting portion when the at least one slide bearing member is installed to the at least one of the two shaft end portions along the rotation axis of the shaft, wherein the at least one slide bearing member has a cylindrical shape including an inner hollow into which the at least one of the two shaft end portions is inserted, and by fitting the inner hollow of the at least one slide bearing member from an outside of the shaft to the at least one of the two shaft end portions along the rotation axis, the projecting portion is inserted from the outside of the shaft to a space between the pair of preventing portions along the rotation axis and the pair of preventing portions prevents rotation of the at least one slide bearing member relative to the at least one of the roller attachment parts.

41. The image forming apparatus according to claim 40, wherein the projecting portion has a pair of flat faces parallel to each other, one of the pair of preventing portions contacts one of the pair of flat faces to prevent clockwise rotation of the projecting portion, and the other of the pair of preventing portions contacts the other of the pair of flat faces to prevent counterclockwise rotation of the projecting portion.

* * * * *